US009102117B2

(12) United States Patent
Suzuki et al.

(10) Patent No.: US 9,102,117 B2
(45) Date of Patent: Aug. 11, 2015

(54) SHEET PROCESSING APPARATUS, IMAGE FORMING SYSTEM, AND SHEET FOLDING METHOD

(71) Applicants: Yuuji Suzuki, Kanagawa (JP); Tomohiro Furuhashi, Kanagawa (JP); Shuuya Nagasako, Kanagawa (JP); Akira Kunieda, Tokyo (JP); Michitaka Suzuki, Kanagawa (JP); Kyosuke Nakada, Kanagawa (JP); Kazuya Yamamoto, Kanagawa (JP); Takahiro Watanabe, Kanagawa (JP); Kiichiro Goto, Kanagawa (JP)

(72) Inventors: Yuuji Suzuki, Kanagawa (JP); Tomohiro Furuhashi, Kanagawa (JP); Shuuya Nagasako, Kanagawa (JP); Akira Kunieda, Tokyo (JP); Michitaka Suzuki, Kanagawa (JP); Kyosuke Nakada, Kanagawa (JP); Kazuya Yamamoto, Kanagawa (JP); Takahiro Watanabe, Kanagawa (JP); Kiichiro Goto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/070,932

(22) Filed: Nov. 4, 2013

(65) Prior Publication Data

US 2014/0141956 A1 May 22, 2014

(30) Foreign Application Priority Data

Nov. 16, 2012 (JP) ..... 2012-252423

(51) Int. Cl.
*B65H 45/20* (2006.01)
*B31F 1/10* (2006.01)
*B31F 1/00* (2006.01)
*B65H 45/14* (2006.01)

(52) U.S. Cl.
CPC ..... *B31F 1/10* (2013.01); *B31F 1/0025* (2013.01); *B65H 45/14* (2013.01); *B65H 45/147* (2013.01); *B65H 45/20* (2013.01)

(58) Field of Classification Search
CPC ..... B31F 1/10; B31F 1/0025; B65H 45/20; B65H 45/147
USPC ..... 270/32, 39.01; 493/416, 419, 421, 434, 493/435, 440, 442
See application file for complete search history.

(56) References Cited

U.S. PATENT DOCUMENTS

| | | | | |
|---|---|---|---|---|
| 3,328,026 | A * | 6/1967 | Bartizal, Jr. | 493/421 |
| 3,729,186 | A * | 4/1973 | Macke | 493/360 |
| 4,619,101 | A * | 10/1986 | Havey et al. | 53/117 |
| 4,621,966 | A * | 11/1986 | Luperti et al. | 414/789.9 |
| 5,364,332 | A | 11/1994 | Gray, Jr. | |
| 5,871,433 | A * | 2/1999 | Lehmann et al. | 493/420 |
| 6,761,677 | B1 * | 7/2004 | Manico et al. | 493/424 |

(Continued)

FOREIGN PATENT DOCUMENTS

| | | | |
|---|---|---|---|
| CA | 2285916 C | * | 12/2003 |
| JP | 07-069529 | | 3/1995 |

(Continued)

*Primary Examiner* — Leslie A Nicholson, III
(74) *Attorney, Agent, or Firm* — Harness, Dickey & Pierce, P.L.C.

(57) ABSTRACT

A sheet processing apparatus includes: a first pair of conveying members that convey a sheet; a second pair of conveying members that receive the sheet conveyed by the first pair of the conveying members and further conveys the sheet to a subsequent stage; and a third pair of conveying members that fold the sheet by rotating the second pair of the conveying members in a reverse direction while the sheet is held by the first pair of the conveying members and the second pair of the conveying members. One of the conveying members of the second pair serves as one of the conveying members of the third pair.

20 Claims, 22 Drawing Sheets

(56) References Cited

U.S. PATENT DOCUMENTS

| | | | | |
|---|---|---|---|---|
| 7,261,288 | B2 * | 8/2007 | Hosoya et al. | 270/58.07 |
| 7,794,381 | B2 * | 9/2010 | Yamamoto et al. | 493/421 |
| 2009/0062100 | A1 | 3/2009 | Takekawa et al. | |
| 2009/0129840 | A1 | 5/2009 | Takekawa et al. | |
| 2011/0190109 | A1 | 8/2011 | Kimata | |
| 2011/0221125 | A1 | 9/2011 | Kimata | |

FOREIGN PATENT DOCUMENTS

| | | |
|---|---|---|
| JP | 2003-020163 | 1/2003 |
| JP | 2005-231777 | 9/2005 |
| JP | 2006-117383 | 5/2006 |

* cited by examiner

SHEET PROCESSING APPARATUS, IMAGE FORMING SYSTEM, AND SHEET FOLDING METHOD

CROSS-REFERENCE TO RELATED APPLICATIONS

The present application claims priority to and incorporates by reference the entire contents of Japanese Patent Application No. 2012-252423 filed in Japan on Nov. 16, 2012.

BACKGROUND OF THE INVENTION

1. Field of the Invention

The present invention relates to a sheet processing apparatus, an image forming system, and a sheet folding method. In particular, the present invention relates to a sheet processing apparatus that folds a sheet recording medium (hereinafter, referred to as "a sheet"), such as a sheet of paper, a transfer sheet, a printing sheet, or an overhead projector (OHP) sheet, conveyed thereto, an image forming system including the sheet processing apparatus and an image forming apparatus, such as a copier, a printer, a facsimile machine, or a digital multifunction peripheral, and a sheet folding method performed by the sheet processing apparatus.

2. Description of the Related Art

Sheet processing apparatuses that fold a sheet conveyed from an image forming apparatus have been known as disclosed in, for example, Japanese Patent Application Laid-open No. 2006-117383. The sheet processing apparatus disclosed in the above document includes a first stop member, which is arranged in a second conveying path and the position of which can be changed to stop the leading end of a sheet; a conveying roller pair formed of a first conveying roller and a second conveying roller that sandwich a deflected portion of the sheet formed by the first stop member to thereby form a crease; a second stop member, which is arranged in a first conveying path and the position of which can be moved to stop the sheet that has passed through between the conveying roller pair; and a conveying roller pair formed of the second conveying roller and a third conveying roller that sandwich a deflected portion of the sheet formed by the second stop member to thereby form a crease. In the sheet processing apparatus, the stop position of the second stop member is controlled to perform four-folding.

In the technology as described above, the apparatus includes, for a folding process, a stopper and a dedicated path branching from a conveying path used to convey a sheet from an upstream device to a downstream device, and performs the folding process based on a so-called end-abutting in which a leading end of a sheet is caused to abut. That is, in the folding process, the sheet is caused to abut against the stopper in the dedicated path to adjust a folding position and form the deflected portion, and the deflected portion is nipped by a folding unit to fold the sheet.

However, in the sheet processing apparatus disclosed in Japanese Patent Application Laid-open No. 2006-117383, it is necessary to provide a branch path branching from a conveying path used to convey a sheet from an upstream device to a downstream device, and a stopper against which the leading end of the sheet is caused to abut to adjust the folding position. Furthermore, the position of the stopper needs to be changed depending on the length of the sheet or a type of folding. Therefore, a large moving range of the stopper needs to be ensured and a moving mechanism for moving the stopper needs to be provided. To ensure the moving range and provide the moving mechanism, the size of the apparatus is increased.

Therefore, there is a need to enable a folding process with a conveying path of a short length and reduce the size of the apparatus.

SUMMARY OF THE INVENTION

It is an object of the present invention to at least partially solve the problems in the conventional technology.

A sheet processing apparatus includes: a first pair of conveying members that convey a sheet; a second pair of conveying members that receive the sheet conveyed by the first pair of the conveying members and further conveys the sheet to a subsequent stage; and a third pair of conveying members that fold the sheet by rotating the second pair of the conveying members in a reverse direction while the sheet is held by the first pair of the conveying members and the second pair of the conveying members. One of the conveying members of the second pair serves as one of the conveying members of the third pair.

A sheet processing apparatus includes: a first conveying member that conveys a sheet along a first conveying path; a second conveying member including a first conveying roller, a second conveying roller, a third conveying roller, and a fourth conveying roller; and a second conveying path though which a sheet subjected to a folding process is discharged. The first conveying roller forms a nip with the second conveying roller while sandwiching the first conveying path. The fourth conveying roller forms a nip with the second conveying roller while sandwiching the second conveying path. The third conveying roller forms a nip with the second conveying roller, between the first conveying path and the second conveying path. The second conveying roller is rotated in a reverse direction while the sheet is held by the first conveying member and the second conveying member, to thereby fold the sheet by the nip between the second conveying roller and the third conveying roller to form a first crease. A regulator member regulates a leading end at which the first crease is formed, in the second conveying path, to thereby fold the sheet by the nip between the second conveying roller and the fourth conveying roller to form a second crease.

A sheet processing apparatus includes: a first conveying member that conveys a sheet along a first conveying path; a second conveying member including a first conveying roller, a second conveying roller, and a third conveying roller; a second conveying path through which a sheet subjected to a folding process is discharged; and a fourth conveying roller that forms a nip with the third conveying roller. The first conveying roller forms a nip with the second conveying roller while sandwiching the first conveying path. The fourth conveying roller forms a nip with the third conveying roller while sandwiching the second conveying path. The third conveying roller forms a nip with the second conveying roller, between the first conveying path and the second conveying path. The second conveying roller is rotated in a reverse direction while the sheet is held by the first conveying member and the second conveying member, to thereby fold sheet by the nip between the second conveying roller and the third conveying roller to form a first crease. A regulator member regulates a leading end at which the first crease is formed, in the second conveying path, to thereby fold the sheet by the nip between the third conveying roller and the fourth conveying roller to form a second crease.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In an embodiment of the present invention, a sheet folding position is adjusted by a nip and a reverse movement of a conveying member provided on a sheet conveying path, and a folding process is performed by the conveying member.

Embodiments of the present invention will be explained in detail below with reference to the accompanying drawings.

Figure 1:
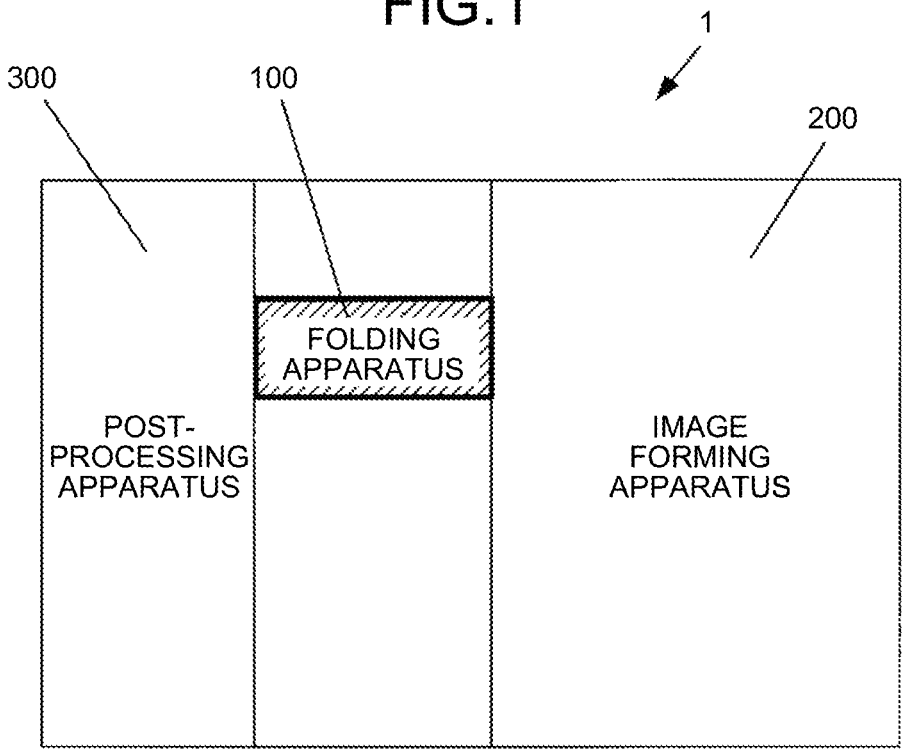
FIG. 1 is a diagram illustrating an overall configuration of an image forming system according to an embodiment of the present invention.

FIG. 1 is a diagram illustrating an overall configuration of an image forming system according to an embodiment of the present invention. In FIG. 1, an image forming system 1 according to the embodiment mainly includes an image forming apparatus 200, a folding apparatus 100, and a post-processing apparatus 300. The folding apparatus 100 is disposed between the preceding image forming apparatus 200 and the subsequent post-processing apparatus 300. The folding apparatus 100 receives a sheet on which an image is formed by the image forming apparatus 200, performs a predetermined folding process on the sheet, and conveys the sheet to the post-processing apparatus 300. The post-processing apparatus 300 performs post-processing, such as aligning, stitching, or bookbinding, on a sheet subjected to the folding process or a sheet that is not subjected to the folding process.

Figure 2:
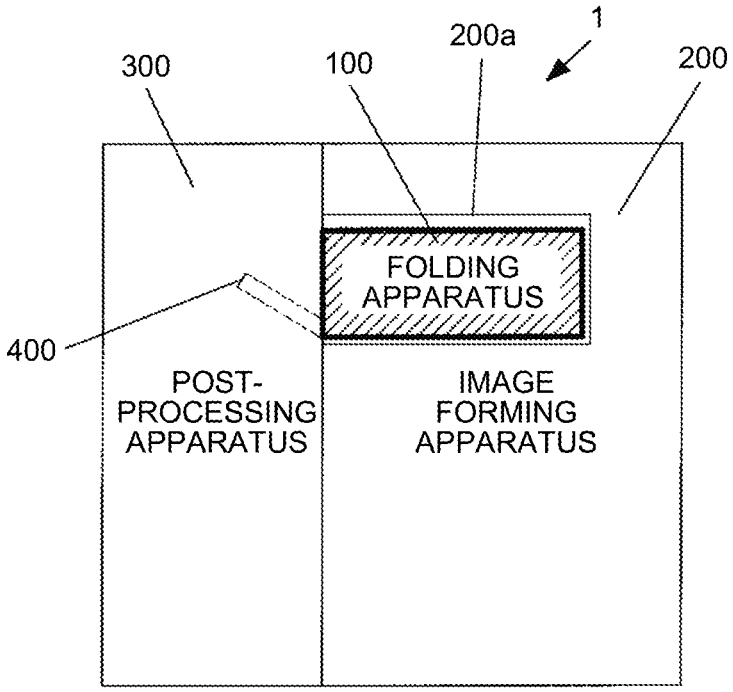
FIG. 2 is a diagram illustrating an overall configuration of an image forming system according to another embodiment of the present invention.

FIG. 2 is a diagram illustrating an overall configuration of an image forming system according to another embodiment of the present invention. In FIG. 2, the folding apparatus 100 is of a so-called body inside installation type and is provided in a sheet discharge unit inside the image forming apparatus 200. In the image forming system 1 illustrated in FIG. 2, the folding apparatus 100 is disposed in a body inside sheet discharge unit 200*a* of the image forming apparatus 200, and only a discharge tray 400 protrudes from the footprint of the image forming apparatus 200. Therefore, the size of the system is greatly reduced compared with the system illustrated in FIG. 1.

Figure 3:
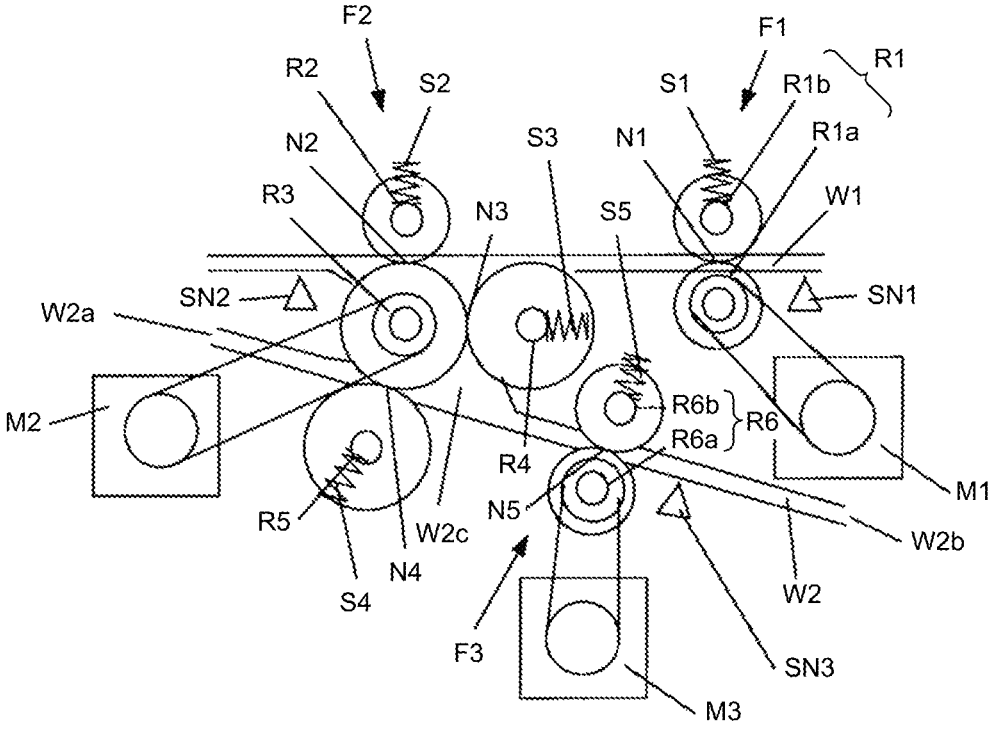
FIG. 3 is a diagram illustrating a folding mechanism of a folding apparatus illustrated in FIG. 1 and FIG. 2.

FIG. 3 is a diagram illustrating a folding mechanism of the folding apparatus 100 illustrated in FIG. 1 and FIG. 2.

The folding apparatus 100 includes two conveying paths, that is, a first conveying path W1 and a second conveying path W2. A first conveying member F1, a second conveying member F2, and a third conveying member F3 are arranged along the two conveying paths W1 and W2. The second conveying member F2 is arranged so as to sandwich the first conveying path W1 and the second conveying path W2 and has a function to fold a sheet P and send the sheet P from the first conveying path W1 to the second conveying path W2.

The first conveying member F1 includes a first conveying roller pair R1. The second conveying member F2 includes a first conveying roller R2, a second conveying roller R3, a third conveying roller R4, and a fourth conveying roller R5. The third conveying member F3 includes a second conveying roller pair R6. The first and the second conveying roller pairs R1 and R6 (the first and the third conveying members F1 and F3) are driven by a first drive motor M1 and a third drive motor M3, respectively, and give conveying force to the sheet P.

The first conveying roller pair R1 is arranged near an entrance of the folding apparatus 100 on the first conveying path W1, receives the sheet P from the preceding image forming apparatus 200, and conveys the sheet P downstream in the folding apparatus 100 by being driven by the first drive motor M1.

Figure 5:
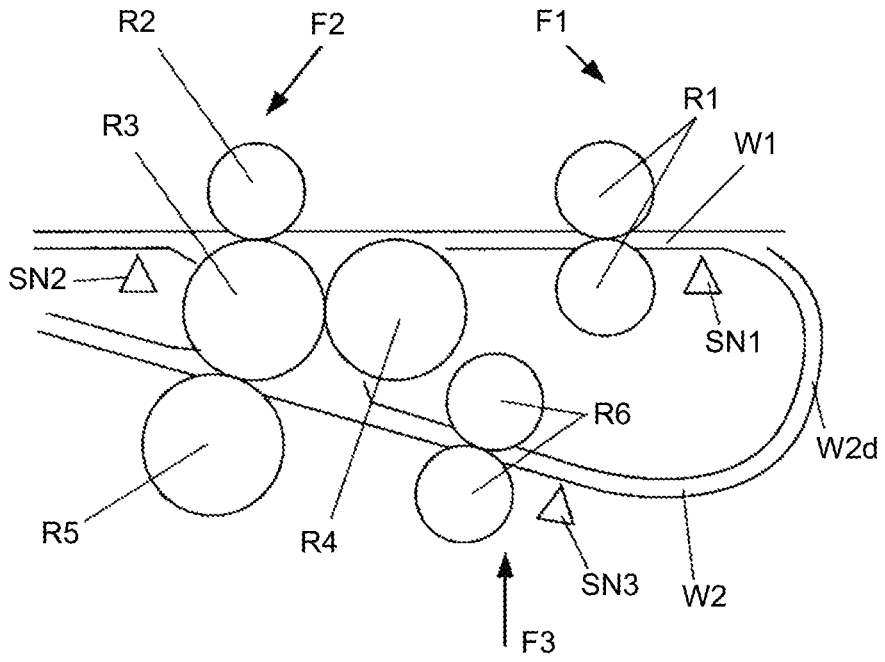
FIG. 5 is a diagram for explaining operation in an initial state before a sheet is conveyed from the image forming apparatus when two-folding is performed.

The second conveying path W2 of the embodiment is configured such that an end portion W2*a* on the downstream side in the sheet conveying direction (a sheet discharge side) is connected to the downstream part of the first conveying path W1 (the connection is not illustrated in the drawings), and an end portion W2*b* on the upstream side in the sheet conveying direction is connected to the part of the first conveying path W1 upstream of the first conveying roller pair R1 (see FIG. 5). Furthermore, the first conveying path W1 is connected to the second conveying path W2 via a communication path W2*c* at the installation position of the second conveying member F2 downstream of the first conveying roller pair R1.

In the second conveying member F2, the first and the second conveying rollers R2 and R3 are arranged opposite each other across the first conveying path W1, and a second nip N2 is formed therebetween. Furthermore, the second and the third conveying rollers R3 and R4 are arranged opposite each other between the first conveying path W1 and the second conveying path W2, and a third nip N3 is formed therebetween. A path in which guide is performed by the third nip N3 functions as the communication path W2*c* for guiding the sheet from the first conveying path W1 to the second conveying path W2. Moreover, the second and the fourth conveying rollers R3 and R5 are arranged opposite each other across the second conveying path W2, and a fourth nip N4 is formed therebetween.

The first to the fourth conveying rollers R2 to R5 are driven by a second drive motor M2 that drives the second conveying roller R3. That is, the second conveying member F2 is driven by the second drive motor M2. The second drive motor M2 can rotate both in a forward direction and a reverse direction, and the rotation direction is changed to convey the sheet P and perform a folding process. The second conveying member F2 may be formed by an adhesive conveying roller pair or a suction belt, instead of the conveying roller pair.

In the second conveying member F2, the second conveying roller R3 serves as a driving conveying roller and the first, the third, and the fourth conveying rollers R2, R4, and R5 serve as driven conveying rollers that rotate by being in contact with the second conveying roller R3. The second and the third conveying rollers R3 and R4 serve as a first folding means, and the second and the fourth conveying rollers R3 and R5 serve as a second folding means.

A first compression spring S2, a second compression spring S3, and a third compression spring S4 (which are elastic members) apply elastic force to the first, the third, and the fourth conveying rollers R2, R4, and R5, respectively, toward the second conveying roller R3, so that the contact with the second conveying roller R3 is maintained. Therefore, the three conveying rollers R2, R4, and, R5 are driven by receiving the driving force from the second conveying roller R3.

The first conveying roller pair R1 is formed of a driving conveying roller R1*a* and a driven conveying roller R1*b*, and the first drive motor M1 gives driving force to the driving conveying roller R1*a*. A first compression spring S1 applies elastic force to the driven conveying roller R1*b* toward the driving conveying roller R1*a*, so that the driven conveying roller R1*b* comes in contact with the driving conveying roller R1*a* at a first nip N1 and is driven in that state. The second conveying roller pair R6 is formed of a driving conveying roller R6*a* and a driven conveying roller R6*b*, and the third drive motor M3 gives driving force to the driving conveying roller R6*a*. A fifth compression spring S5 applies an elastic force to the driven conveying roller R6*b* toward the driving conveying roller R6*a*, so that the driven conveying roller R6*b* comes in contact with the driving conveying roller R6*a* at a fifth nip N5 and is driven in that state.

A first sheet detection sensor SN1 is disposed just before the first conveying roller pair R1 in the first conveying path W1. A second sheet detection sensor SN2 is disposed just after the first and the second conveying rollers R2 and R3. A third sheet detection sensor SN3 is disposed close to the second conveying roller pair R6 on the side away from the fourth conveying roller R5 in the second conveying path W2. The first sheet detection sensor SN1 functions as an entrance sheet detection sensor and the second sheet detection sensor SN2 functions as a discharge sheet detection sensor.

Figure 4:
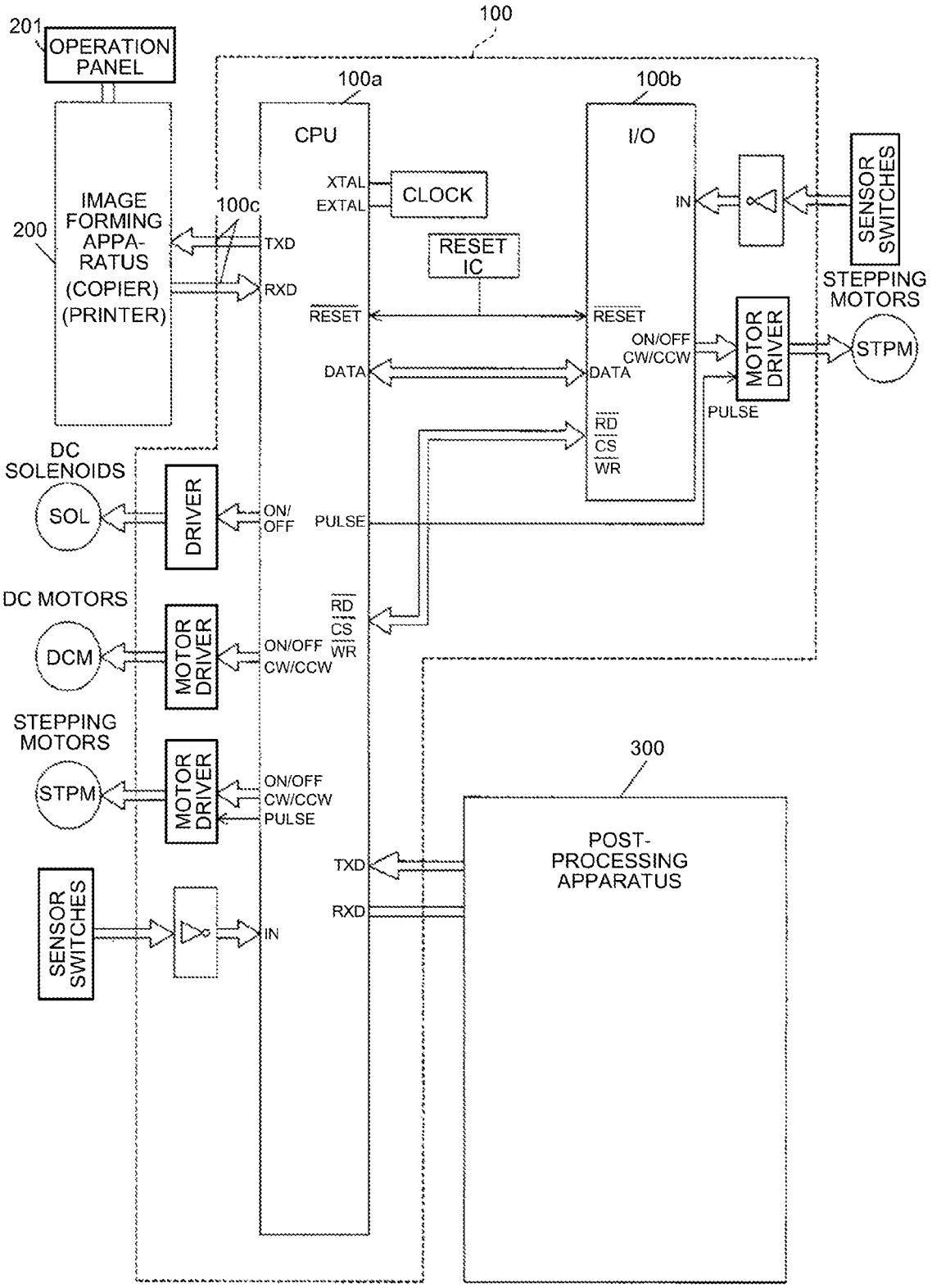
FIG. 4 is a block diagram illustrating a control configuration of the image forming system according to the embodiment of the present invention.

FIG. 4 is a block diagram illustrating a control configuration of the image forming system according to the embodiment.

In FIG. 4, the folding apparatus 100 includes a control circuit provided with a microcomputer including a CPU 100*a*, an input/output (I/O) interface 100*b*, and the like. A signal from a CPU of the image forming apparatus 200, each switch of an operation panel 201, each sheet detection sensor (not illustrated), or the like is input to the CPU 100*a* via a communication interface 100*c*. The CPU 100*a* performs predetermined control based on the signals input from the image forming apparatus 200. The CPU 100*a* also controls drive of solenoids and motors via drivers and motor drivers, and acquires information from the sheet detection sensors in the apparatus via the interface. Furthermore, for example, the CPU 100*a* controls drive of motors via motor drives with respect to a control target via the I/O interface 100*b*, and acquires sheet detection sensor information from the sheet detection sensors. The above control is performed by causing the CPU 100*a* to read program codes stored in a read-only memory (ROM) (not illustrated), deploy the program codes into a random access memory (RAM) (not illustrated), and execute programs defined by the program code by using the RAM as a working area and a data buffer.

In the embodiment, the folding mechanism illustrated in FIG. 3 enables two-folding, Z-folding, inward three-folding, and outward three-folding. Each folding operation is performed based on instructions issued by the CPU 100*a* illustrated in FIG. 4.

FIG. 5 to FIG. 12 are diagrams for explaining operation of each of the units when two-folding is performed.

Figure 6:
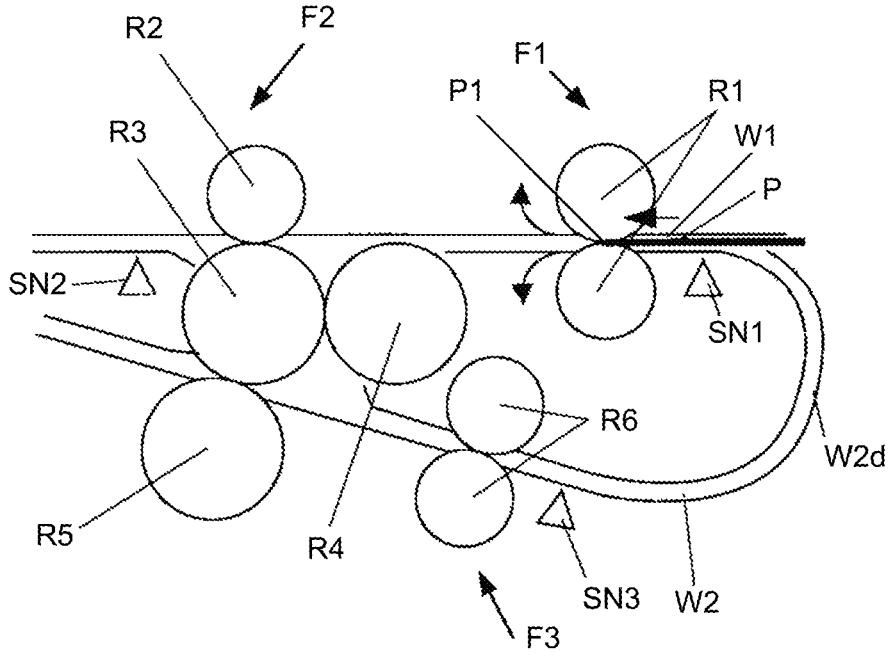
FIG. 6 is a diagram for explaining operation when the sheet is fed from the image forming apparatus to a first conveying path.

FIG. 5 illustrates an initial state before a sheet is conveyed from the image forming apparatus 200. The sheet P is fed from the image forming apparatus 200 to the first conveying path W1 as illustrated in FIG. 6 from the state illustrated in FIG. 5. When the first sheet detection sensor (the entrance sheet detection sensor) SN1 detects a leading end P1 of the sheet P, the first drive motor M1 starts rotating (in the direction of arrow R1). When the sheet P enters the first nip N1 of the first conveying roller pair R1, the sheet P is conveyed toward the downstream second conveying member F2 by the first conveying roller pair R1. When the leading end reaches the first conveying member F2, the sheet P is nipped by the second nip N2 between the first and the second conveying rollers R2 and R3 and is further conveyed downstream in the conveying direction.

Figure 7:
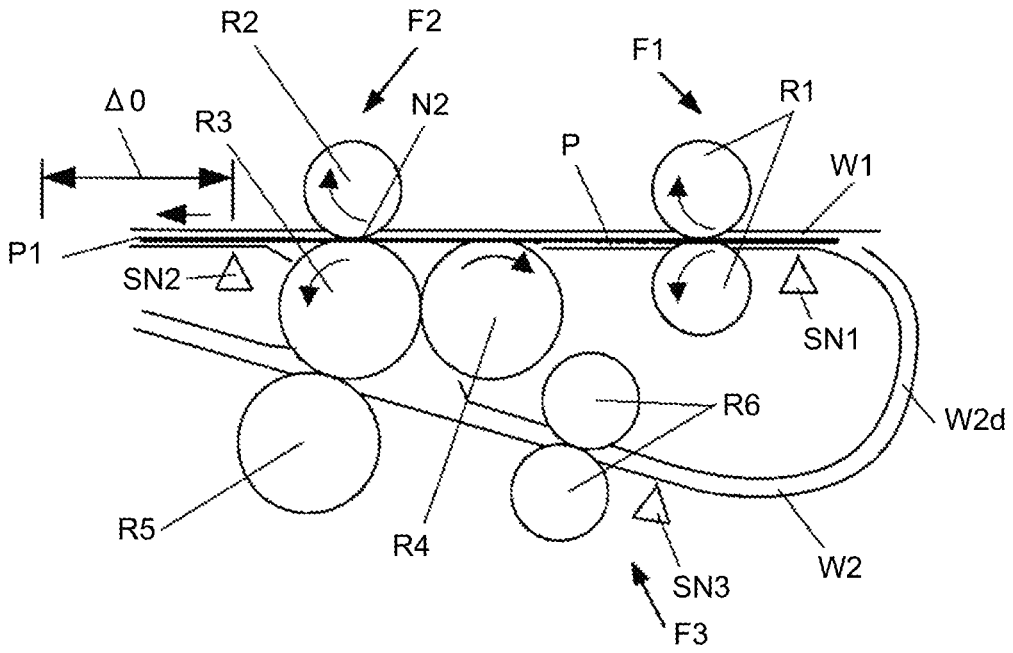
FIG. 7 is a diagram for explaining operation when the sheet is conveyed toward a folding position by a first conveying member and a second conveying member.
Figure 8:
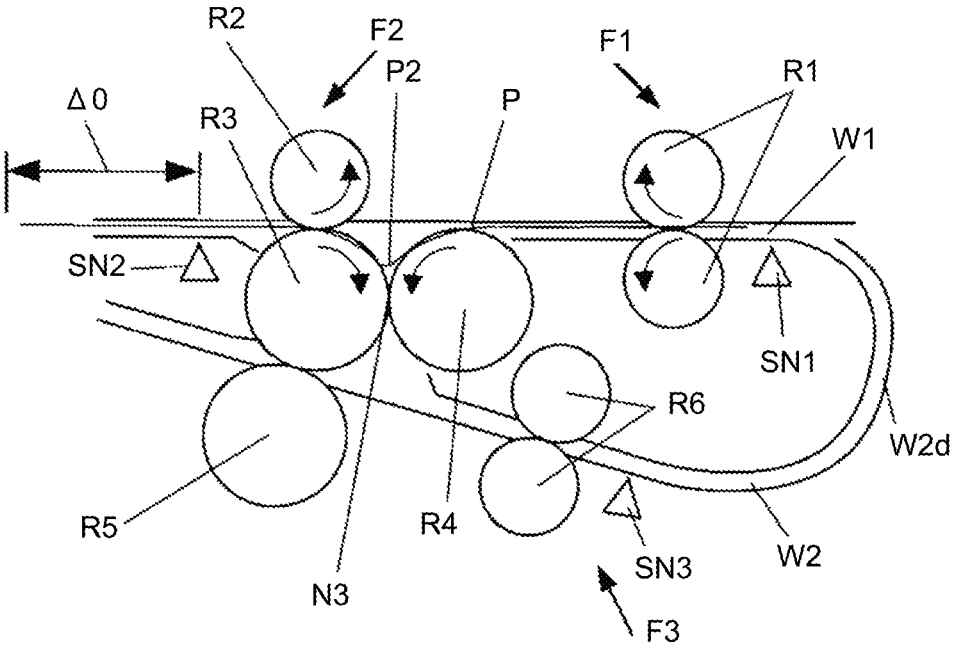
FIG. 8 is a diagram for explaining operation when the second conveying member is rotated in a reverse direction and the sheet is folded at a two-folding position by the second conveying member.

When the second sheet detection sensor SN2 detects the leading end P1 of the sheet P, the second drive motor M2 is decelerated and the sheet P is conveyed to a position corresponding to a protrusion amount Δ0 that is set in advance for the two-folding (FIG. 7). When the sheet reaches the position corresponding to the protrusion amount Δ0, in other words, the position causing the center portion of the sheet P in the conveying direction to be folded by the third nip N3, the rollers are temporarily stopped. Then, reverse rotation is started (FIG. 8). In this case, the first conveying roller pair R1 is also stopped in synchronization with the first and the second conveying rollers R2 and R3, and thereafter, conveys the sheet P downstream in the conveying direction at the same speed as the first and the second conveying rollers R2 and R3.

In this case, the second drive motor M2 is controlled such that the second drive motor M2 is not stopped immediately after the sheet P conveyed from the upstream crosses the detection position of the second sheet detection sensor SN2 but is stopped after the sheet is conveyed by the movement amount Δ0 that is set in advance, and thereafter rotates in the reverse direction. The movement amount Δ0 is set by causing the CPU 100*a* to receive data about the length of the sheet P in the conveying direction from the image forming apparatus 200 before a job is started (before image formation on the sheet P is started), automatically calculate the movement amount based on the data, and use the calculation result. It may be possible to store a table containing a relationship between a sheet size and the movement amount in a ROM or the like and set the movement amount based on the sheet size, instead of performing the calculation.

Figure 9:
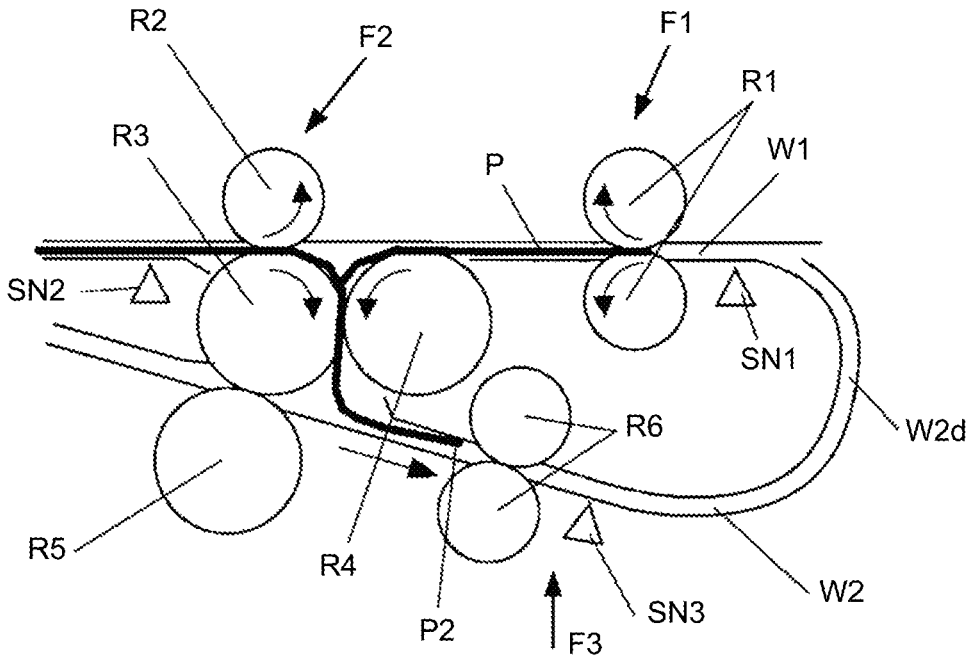
FIG. 9 is a diagram for explaining operation when the sheet folded in two by the second conveying member is conveyed through a second conveying path toward a third conveying member.

When the second drive motor M2 rotates in the reverse direction, as illustrated in FIG. 8, the sheet P is deflected toward the third nip N3 between the second and the third conveying rollers R3 and R4 in the communication path W2*c*, and thereafter, the sheet P is folded by the third nip N3 as illustrated in FIG. 9 and is conveyed toward the second conveying path W2 with a crease P2 at the leading end. Meanwhile, it may be possible to perform the same control by continuing the rotation in a sheet discharging direction without stopping the first conveying roller pair R1.

In the communication path 2Wc, the first conveying path W1 is opened at the side facing the third nip N3 but is closed at the other side; therefore, the sheet P is deflected toward the third nip N3. Nevertheless, to prevent a sheet jam, it may be possible to dispose a guide claw (not illustrated) just before the second nip N2 between the first and the second conveying rollers R2 and R3 to guide the direction toward which the sheet P is deflected, toward the third nip N3 when the first and the second conveying rollers R2 and R3 are rotated in the reverse direction.

Figure 10:
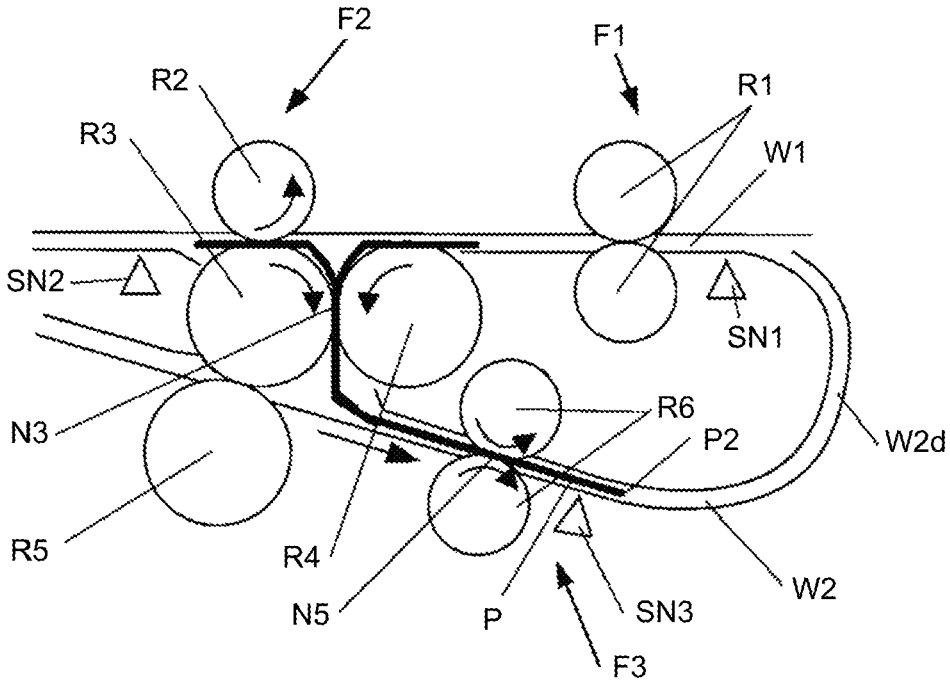
FIG. 10 is a diagram for explaining operation when a crease of the sheet is enhanced by the third conveying member and the sheet is further conveyed through the second conveying path.
Figure 11:
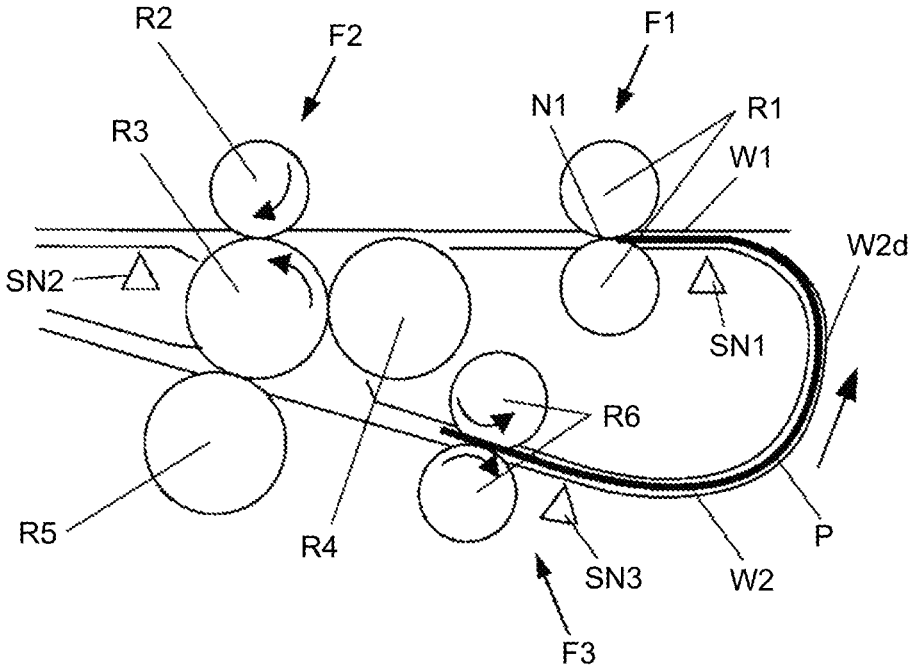
FIG. 11 is a diagram for explaining operation when the sheet is conveyed from the second conveying path to the first conveying path.

As illustrated in FIG. 9, the crease P2 of the sheet P folded by the third nip N3 is guided toward the second conveying roller pair R6 along the inclination of a downward slope of the second conveying path W2, and the crease is enhanced by the fifth nip N5 of the second conveying roller pair R6. Thereafter, the sheet P is conveyed through a connection conveying path W2*d* connecting the second conveying path W2 and the first conveying path W1 and fed to the first nip N1 of the first conveying roller pair R1 from the upstream of the first conveying roller pair R1 (FIG. 10 and FIG. 11).

Figure 12:
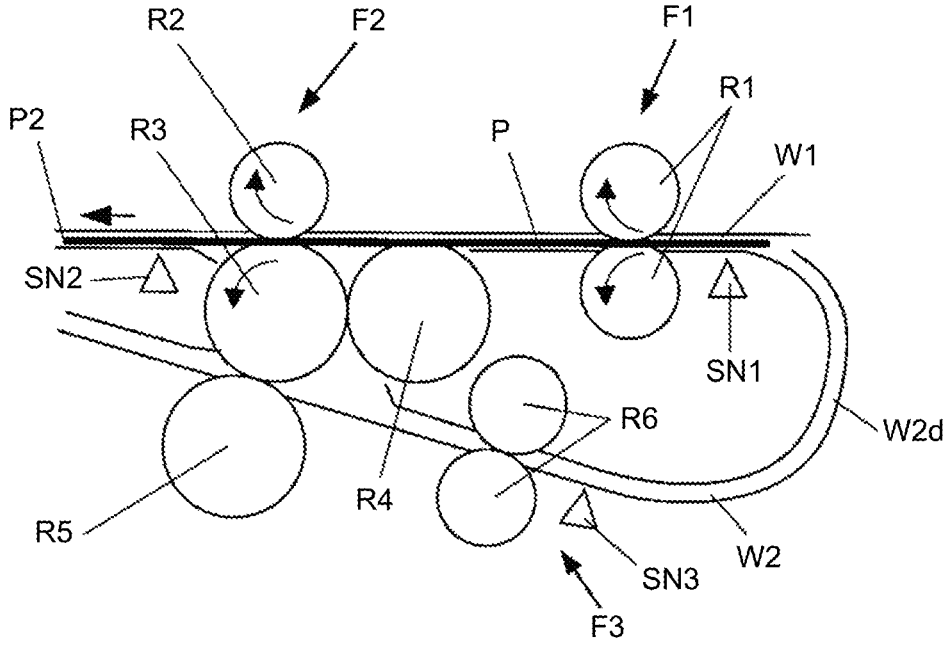
FIG. 12 is a diagram for explaining operation when the two-folded sheet conveyed back to the first conveying path is discharged.
Figure 13:
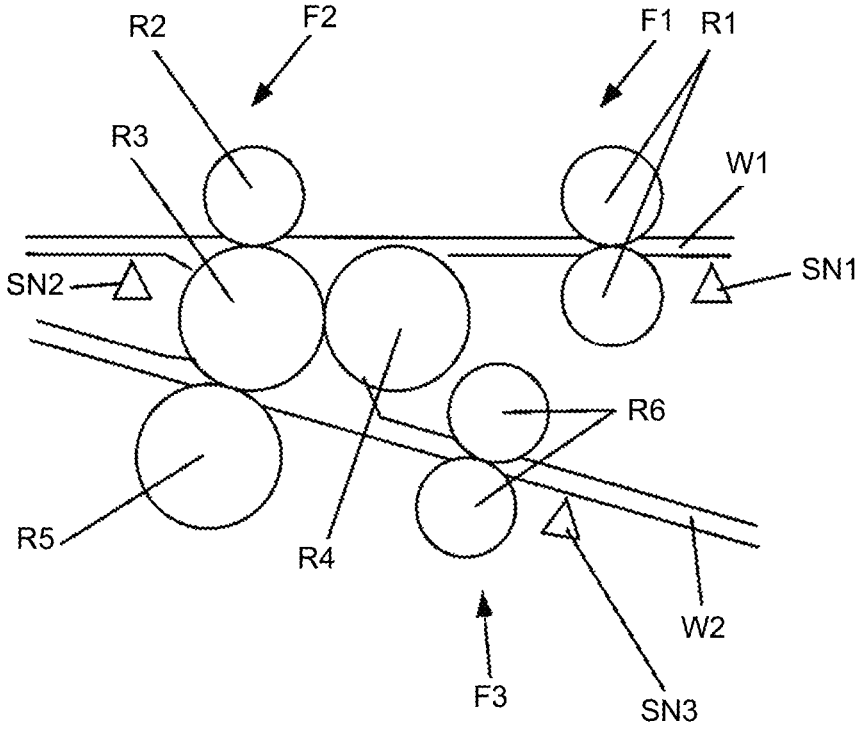
FIG. 13 is a diagram for explaining operation in an initial state before a sheet is conveyed from the image forming apparatus when Z-folding is performed.
Figure 14:
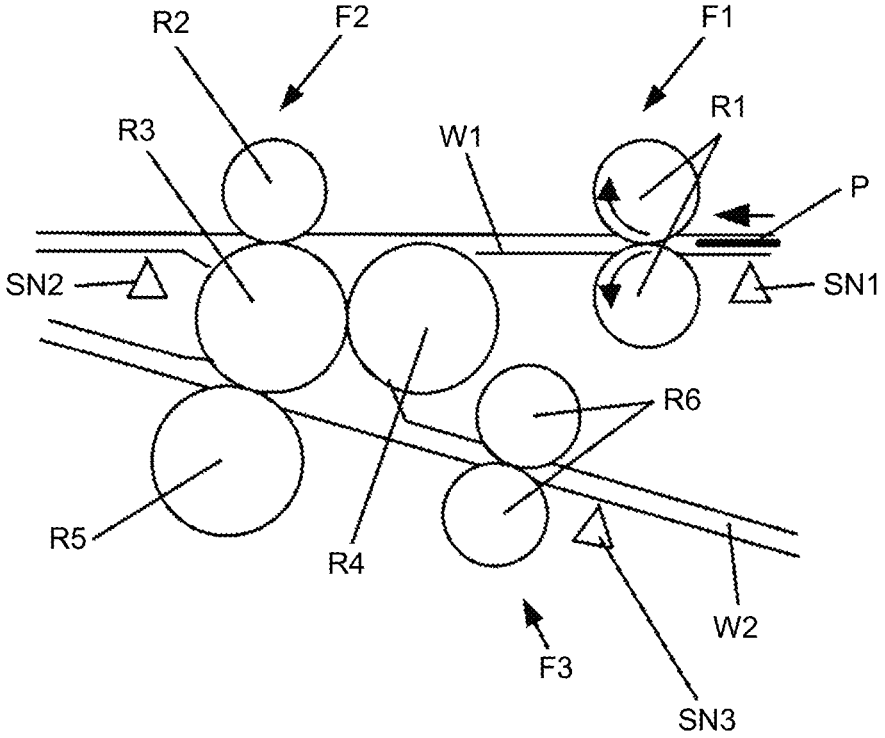
FIG. 14 is a diagram for explaining operation when the sheet is fed from the image forming apparatus side to the first conveying path.

The sheet P fed to the first nip N1 of the first conveying roller pair R1 is further conveyed toward the second conveying member F2 by the first conveying roller pair R1. Thereafter, as illustrated in FIG. 12, the sheet P is sent to a pair of the first and the second conveying rollers R2 and R3 of the second conveying member F2 and discharged to the subsequent stage by the first and the second conveying rollers R2 and R3.

At this time, when a trailing end of the two-folded sheet passes by the third sheet detection sensor SN3, the second and the third drive motors M2 and M3 are stopped. If there is a next sheet, operation from FIG. 5 is repeated, and the two-folded sheet is discharged to the subsequent stage, in particular, to the post-processing apparatus 300 on the subsequent stage in the embodiment.

Incidentally, if the post-processing apparatus 300 is not installed in the subsequent stage, the sheet may be discharged to the discharge tray 400 that is provided instead of the post-processing apparatus 300. Therefore, a system formed of the image forming apparatus 200 and the folding apparatus 100 is the minimum system configuration of the image forming system of the embodiment.

Figure 19:
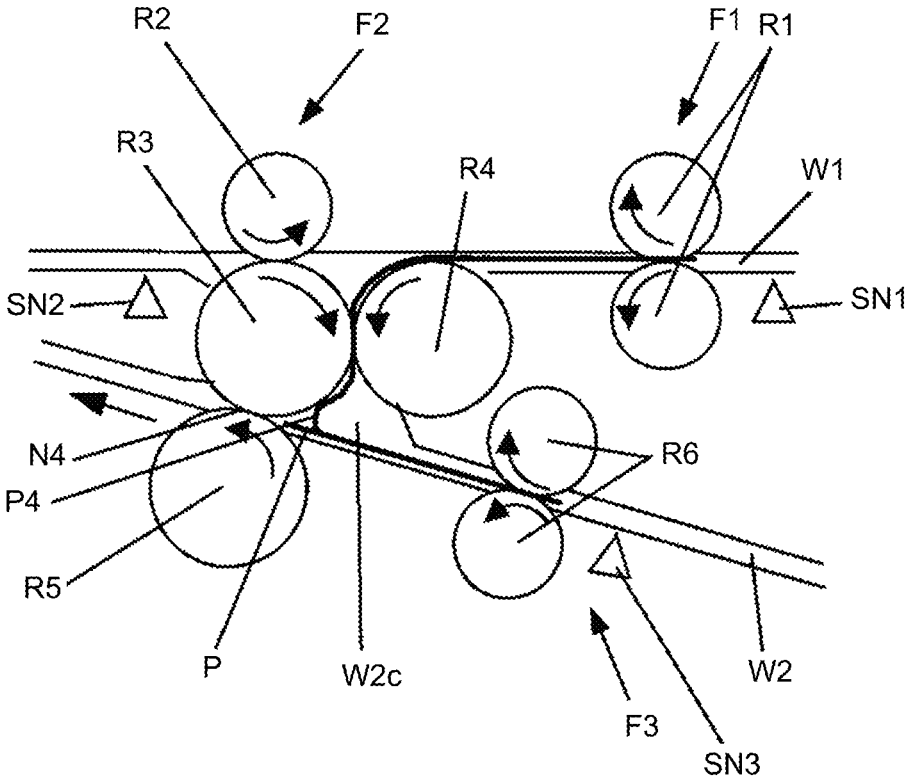
FIG. 19 is a diagram for explaining operation when the third conveying member is rotated in a reverse direction from the state illustrated in FIG. 18 and the sheet is deflected just before a nip of the second conveying member on the second conveying path.
Figure 20:
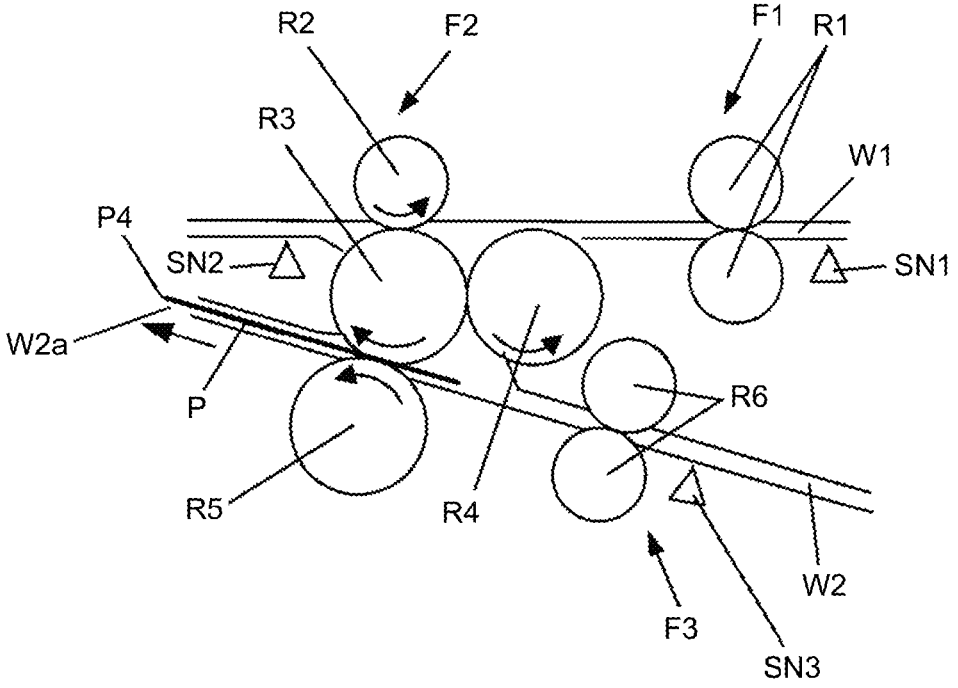
FIG. 20 is a diagram for explaining operation when the sheet is subjected to second folding by the second conveying member from the state illustrated in FIG. 19.
Figure 21:
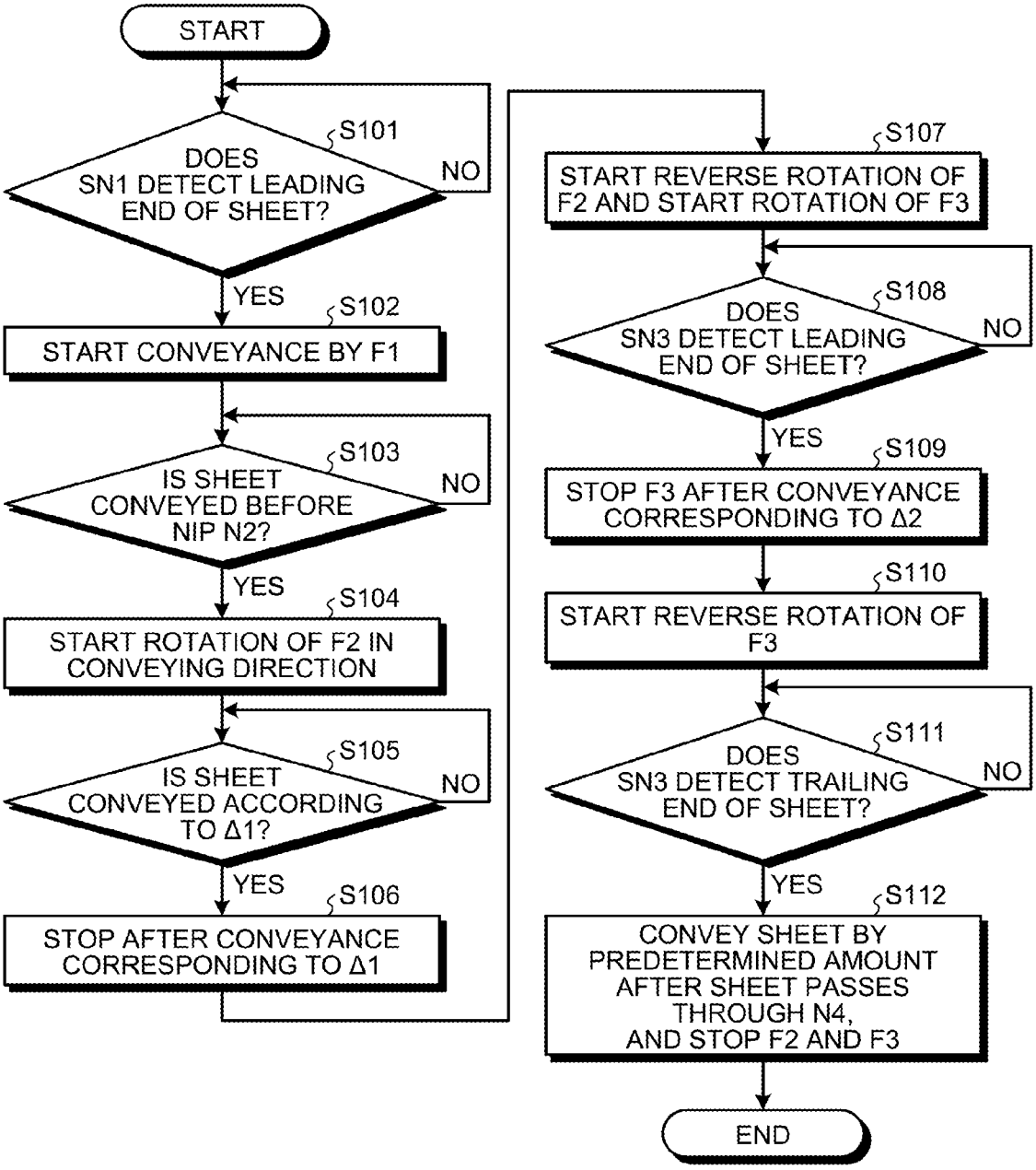
FIG. 21 is a flowchart illustrating the flow for controlling each of the units for the Z-folding.
Figure 22:
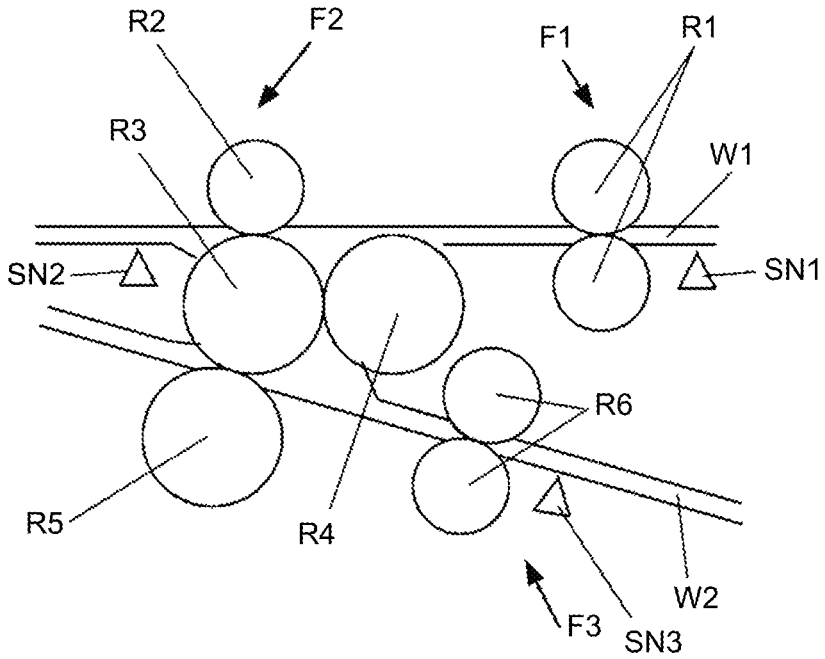
FIG. 22 is a diagram for explaining operation in an initial state before a sheet is conveyed from the image forming apparatus when inward three-folding is performed.
Figure 23:
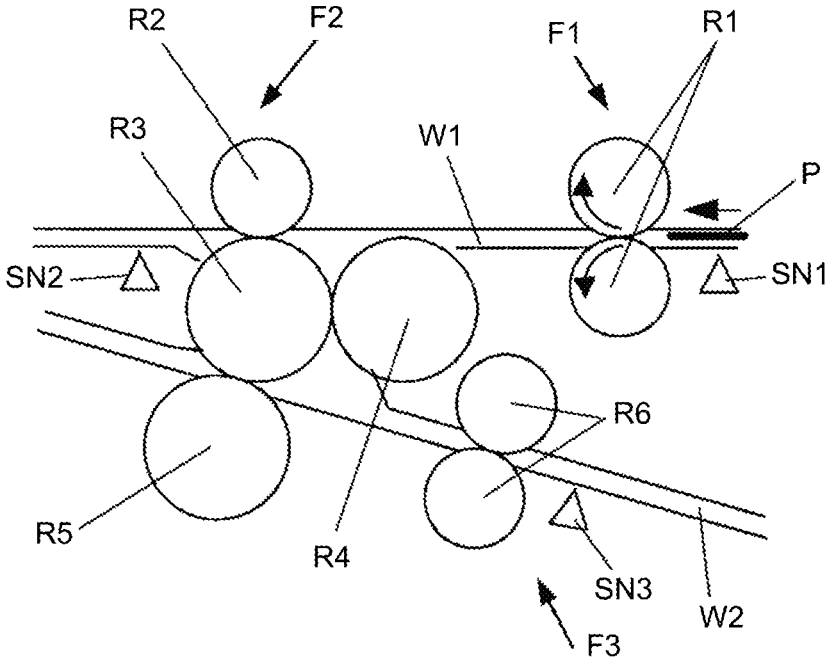
FIG. 23 is a diagram for explaining operation when the sheet is fed from the image forming apparatus to the first conveying path.
Figure 24:
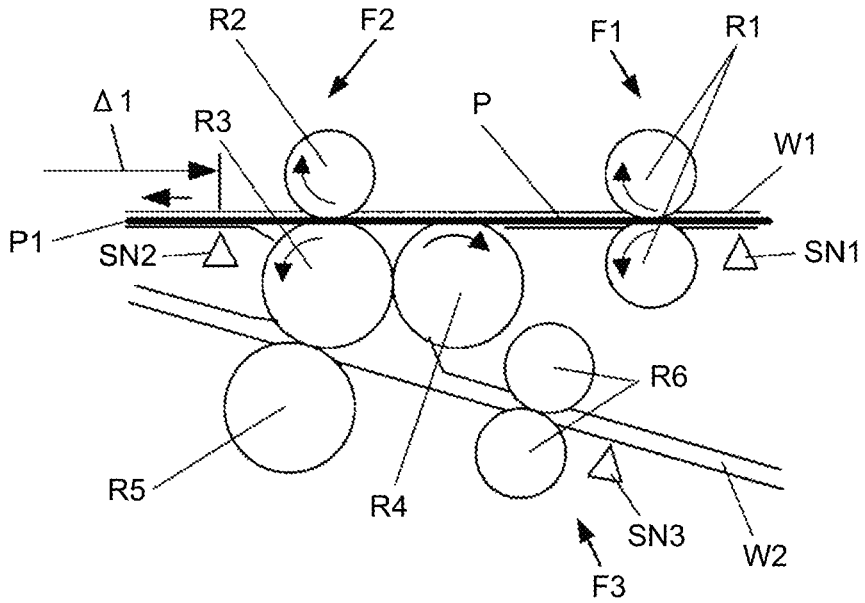
FIG. 24 is a diagram for explaining operation when the sheet is conveyed toward a folding position by the first and the second conveying members.

FIG. 13 to FIG. 20 are diagrams for explaining operation of each of the units when Z-folding is performed. FIG. 21 is a flowchart illustrating the flow for controlling each of the units.

The operation illustrated in FIG. 13 to FIG. 17 is the same as the operation illustrated in FIG. 5 to FIG. 9 except for the operation and the folding position of the two-folding.

In the Z-folding, when the first sheet detection sensor SN1 detects the leading end P1 of the sheet P (Step S101), the first conveying roller pair R1 serving as the first conveying member F1 starts rotating, and when the leading end P1 of the sheet P enters the first nip N1 of the first conveying roller pair R1, the sheet P is conveyed toward the second conveying member F2 (Step S102).

Figure 15:
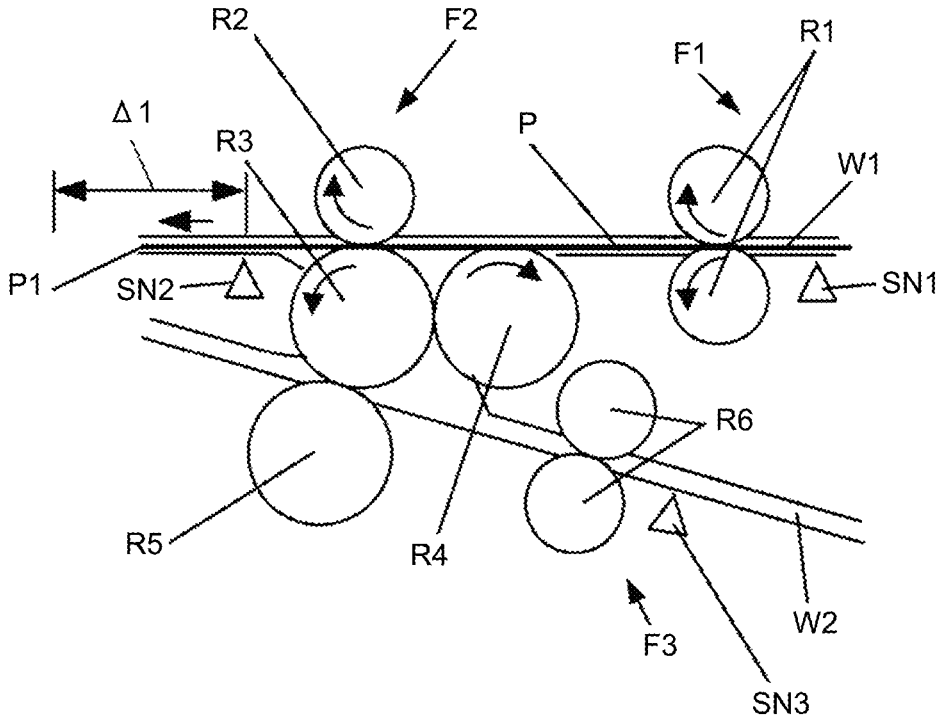
FIG. 15 is a diagram for explaining operation when the sheet is conveyed toward a folding position by the first and the second conveying members.

When the sheet P is conveyed to a position just before the second nip N2 between the second conveying roller R3 and the third conveying roller R4 (Step S103), the second drive motor M2 is driven to rotate the second conveying member F1 in the direction of arrow in FIG. 15 (Step S104). Incidentally, whether the sheet P reaches the position just before the second nip N2 can be determined from, for example, the number of driving steps of the first drive motor M1 that drives the first conveying member F1. To perform the control as described above, in the embodiment, the first, the second, and the third drive motors M1, M2, and M3 are each formed by a stepping motor. The first, the second, and the third drive motors M1, M2, and M3 may be each formed by a motor other than the stepping motor. In this case, a control method corresponding to the type of an employed motor is applied.

Figure 16:
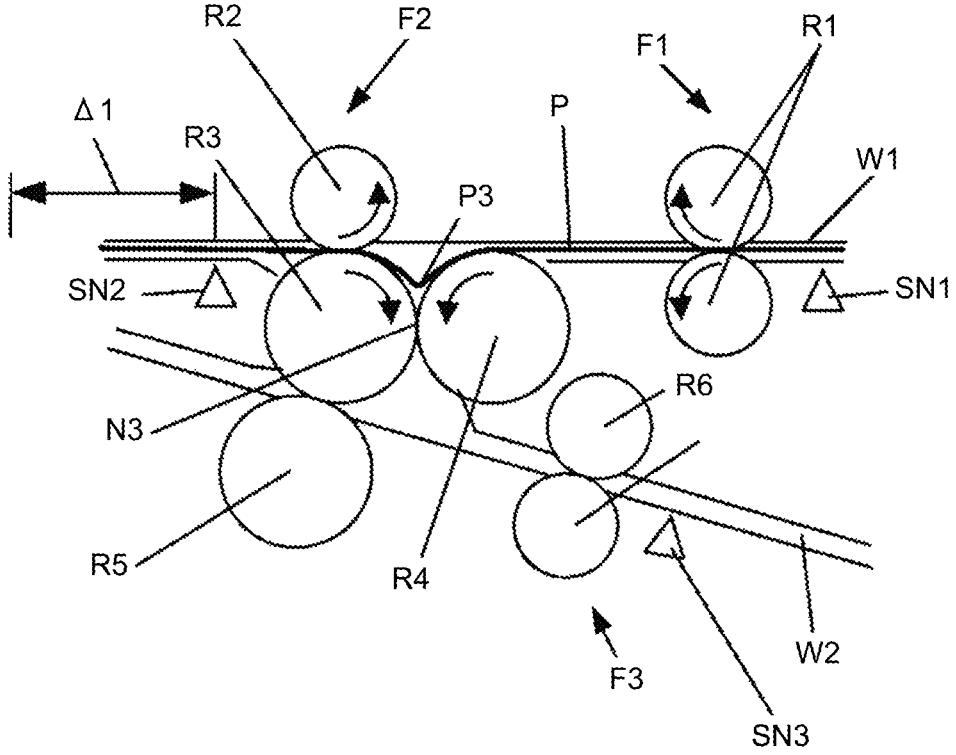
FIG. 16 is a diagram for explaining operation when the second conveying member is rotated in a reverse direction and the sheet is folded at a first folding position for the Z-folding by the second conveying member.
Figure 38A:
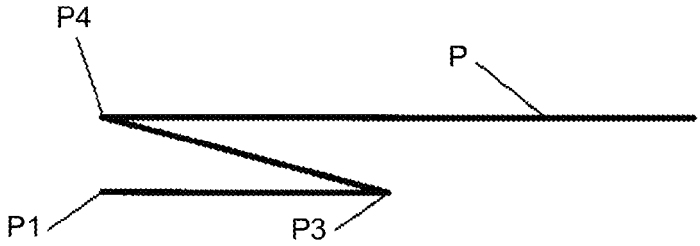
FIGS. 38A to 38C are diagrams for explaining states of the Z-folding, the inward three-folding, and the outward three-folding.

After the second conveying member F1 starts rotating in the direction of arrow in FIG. 15 at Step S104, a protrusion amount (a first protrusion amount) Δ1 from the position of the second sheet detection sensor SN2 is determined in order to set a folding position (Step S105). In the Z-folding, as illustrated in FIG. 38A, mountain fold (first folding) is made at one-fourth of the total length of the sheet P from the leading end P1 of the sheet P in the sheet conveying direction, and then valley fold (second folding) is made at a half of the total length of the sheet P. The position illustrated in FIG. 16 is a position where a crease P3 is formed at one-fourth of the total length of the sheet P from the leading end P1 of the sheet P. This position is also set by performing calculation or referring to a ROM table in the same manner as in the two-folding.

That is, the sheet P is conveyed until the first protrusion amount Δ1 of the leading end P1 of the sheet P is reached from a position where the leading end P1 of the sheet P is detected by the second sheet detection sensor SN2. The first protrusion amount Δ1 is fixed based on the length of the sheet and a type of folding, and is determined based on the amount of rotation of the first conveying roller R2. If the protrusion amount Δ1 of the leading end P1 of the sheet P is reached (YES at Step S105), the second conveying member F2 (the third conveying roller R3) is temporarily stopped (Step S106). At this time, the second conveying member F2 is decelerated in the same manner as in the two-folding before stopping, and is controlled so as to stop with accuracy when the sheet reaches the position corresponding to the first protrusion amount Δ1. Subsequently, the second conveying member F2 (the second conveying roller R3) is rotated in the reverse direction as illustrated in FIG. 16, which is opposite to the conveying direction until the operation in FIG. 15, while maintaining the rotation of the first conveying member F1 in the conveying direction (Step S107). Incidentally, the first protrusion amount Δ1 may be determined based on the amount of conveyance of the first conveying member F1 from the position of the first sheet detection sensor SN1.

Figure 17:
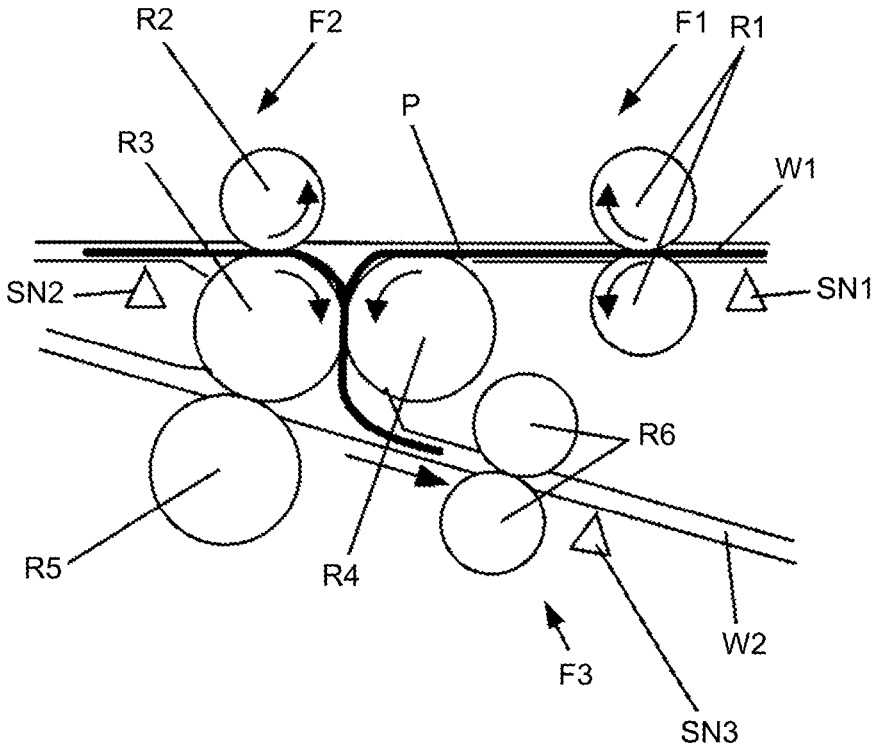
FIG. 17 is a diagram for explaining operation when the sheet subjected to the first folding by the second conveying member is conveyed through the second conveying path toward the third conveying member.

The sheet P is conveyed in the reverse direction due to the reverse rotation of the second conveying member F2 (the second drive motor M2). Meanwhile, the first conveying member F1 is rotated in the same direction as the direction kept from FIG. 14 to convey the sheet P; therefore, similarly to the two-folding, a deflected portion is formed before the third nip N3 (FIG. 16). The deflected portion enters the third nip N3, at which the first folding is performed. As a result, the first crease P3 is formed. The sheet P subjected to the first folding is conveyed to the second conveying path W2 as illustrated in FIG. 17.

Figure 18:
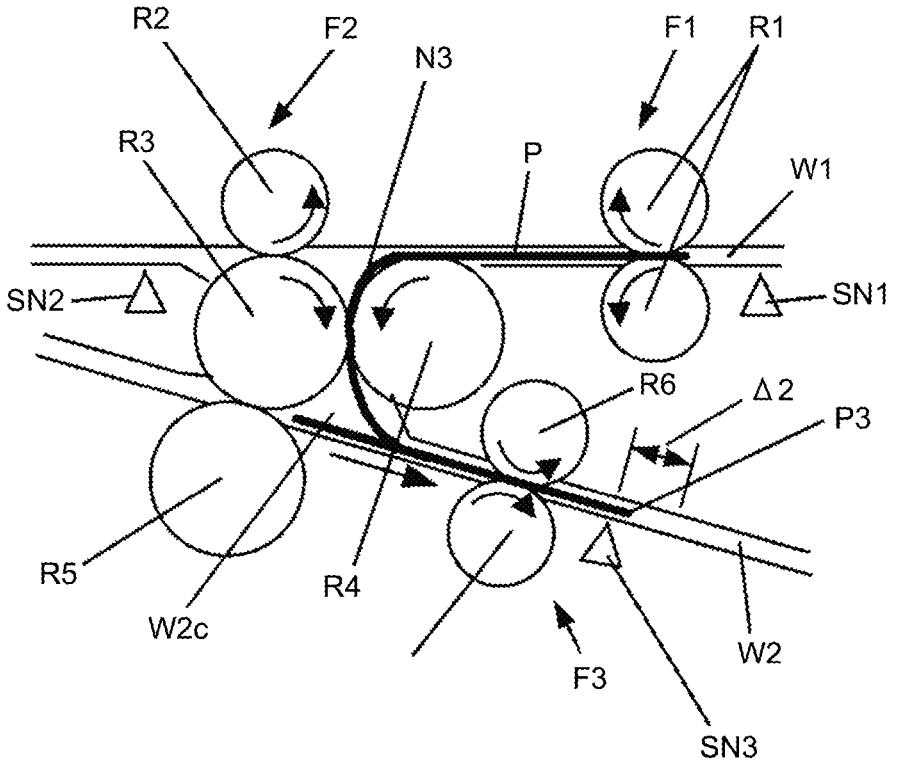
FIG. 18 is a diagram for explaining operation when the sheet is further conveyed by the third conveying member on the second conveying path.

The sheet P is conveyed along the inclination of the downward slope of the second conveying path W2, and is nipped and conveyed by the fifth nip N5 of the second conveying roller pair R6 that has started rotating in the direction of arrow illustrated in FIG. 18, (Step S107). If the third sheet detection sensor SN3 detects the leading end (the first crease P3) of the sheet P (Step S108), and the sheet P reaches a position protruding from the detected position by a second protrusion amount Δ2, the third conveying member F3 (the second conveying roller pair R6, i.e., the third drive motor M3) is stopped (Step S109), and starts rotating in the reverse direction (Step S110), as illustrated in FIG. 19. Incidentally, the second protrusion amount Δ2 may be set as a protrusion amount from the fifth nip N5.

The second protrusion amount Δ2 is fixed based on the length of the sheet and a type of folding, and is determined based on the amount of rotation of the second conveying roller pair R6 (the number of driving steps of the third drive motor M3) similarly to the first protrusion amount Δ1. Furthermore, the third conveying member F3 (the second conveying roller pair R6) is rotated in the reverse direction while the second conveying member F2 (the second and the third conveying rollers R3 and R4) is kept rotating in the rotation direction illustrated in FIG. 17 and FIG. 18. Therefore, as illustrated in FIG. 19, a deflected portion of the sheet P is formed in the communication path W2*c* at the downstream of the third nip N3.

If the second and the third conveying members F2 and F3 are kept driving in the rotation direction as illustrated in FIG. 19, the deflected portion enters the fourth nip N4 between the second conveying roller R3 and the fourth conveying roller R5, and the sheet P is conveyed toward the end portion W2*a* of the second conveying path W2 on the sheet discharge side. During the conveyance, the second folding is performed as illustrated in FIG. 20, so that a second crease P4 is formed on the sheet P. The sheet P subjected to the second folding is conveyed from the end portion W2*a* on the sheet discharge side to the post-processing apparatus 300 on the subsequent stage via the first conveying path W1. Alternatively, the sheet P may be discharged to the discharge tray 400.

Incidentally, in FIG. 20, after the third sheet detection sensor SN3 detects that the trailing end of the sheet P has passed (Step S111) and the trailing end of the sheet P also passes through the fourth nip N4, the rotation of the second and the third conveying members F2 and F3 (the second and the third drive motors M2 and M3) is stopped (Step S112). Furthermore, after the first sheet detection sensor SN1 detects the trailing end of the sheet as illustrated in FIG. 19 and the trailing end of the sheet is separated from the first nip N1, the rotation of the first drive motor M1 is stopped.

Other operations that are not described above are the same as those of the two-folding.

FIG. 22 to FIG. 29 are diagrams for explaining operation of each of the units when inward three-folding is performed. FIG. 30 to FIG. 37 illustrate operation of each of the units when outward three-folding is performed.

Figure 38B:
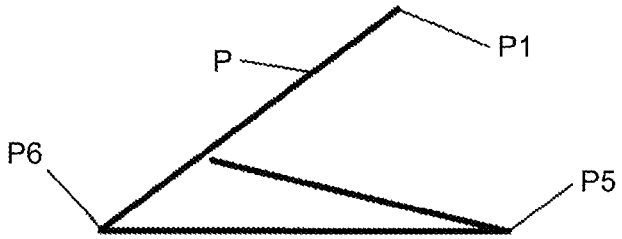
Figure 38C:
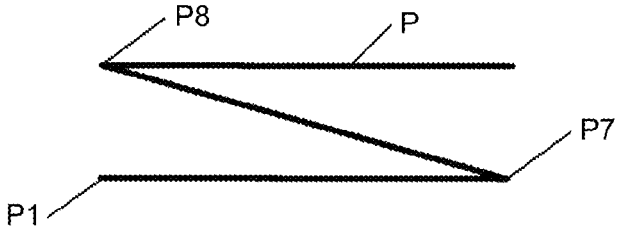

In both of the cases, the operation is the same as the operation of the Z-folding; therefore, the same components are denoted by the same reference numerals and symbols, and the same explanation will not be repeated. However, the first and the second protrusion amounts Δ1 and Δ2 each being fixed based on the length of the sheet or a type of folding, a timing at which the second conveying roller R3 of the second conveying member F2 starts rotating in the reverse direction, and a timing at which the second conveying roller pair R6 of the third conveying member F3 starts rotating in the reverse direction differ from those in the Z-folding. FIG. 38B illustrates a state of the sheet P subjected to the inward three-folding, and FIG. 38C illustrates a state of the sheet P subjected to the outward three-folding. From the drawings, it is clear that the creases P3 and P4 in the Z-folding, creases P5 and P6 in the inward three-folding, and creases P7 and P8 in the outward three-folding differ in the position and the folding direction.

Figure 25:
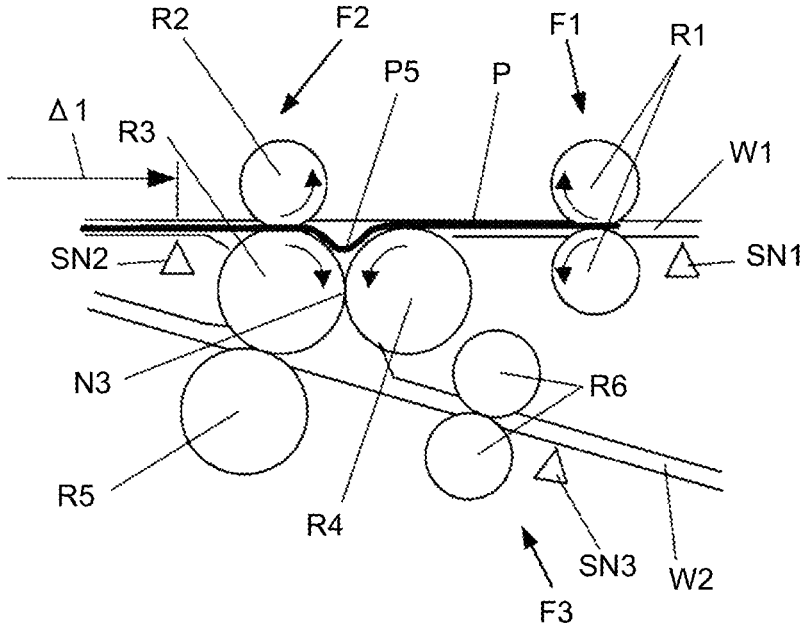
FIG. 25 is a diagram for explaining operation when the second conveying member is rotated in a reverse direction and the sheet is folded at a first folding position for the inward three-folding by the second conveying member.
Figure 26:
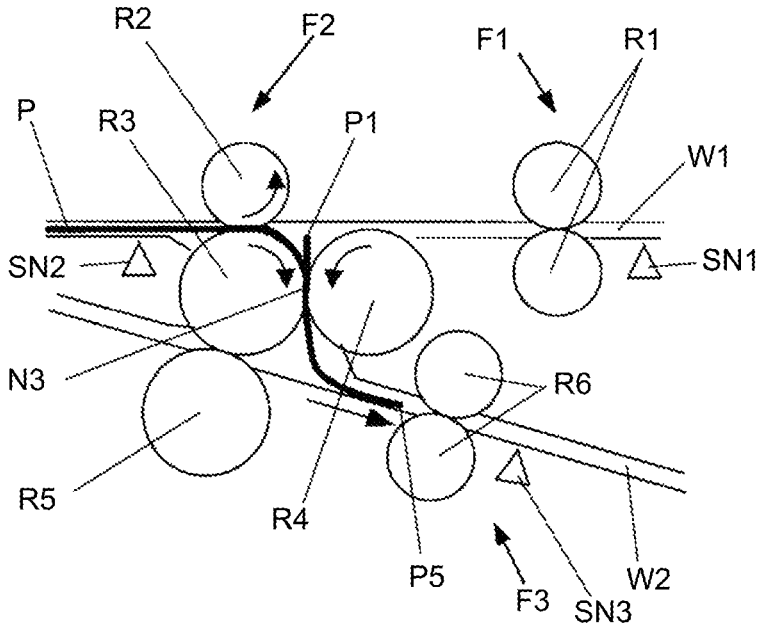
FIG. 26 is a diagram for explaining operation when the sheet subjected to the first folding by the second conveying member is conveyed through the second conveying path toward the third conveying member.
Figure 27:
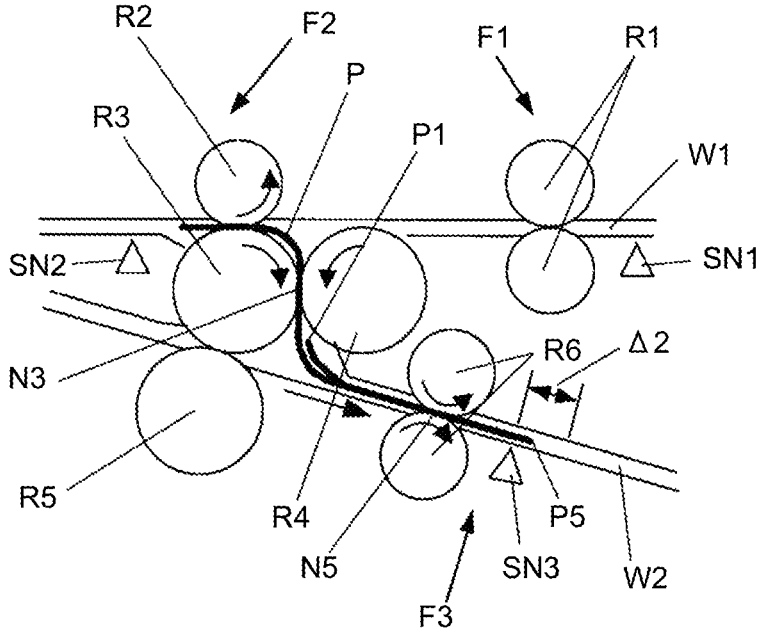
FIG. 27 is a diagram for explaining operation when the sheet is further conveyed by the third conveying member on the second conveying path.
Figure 28:
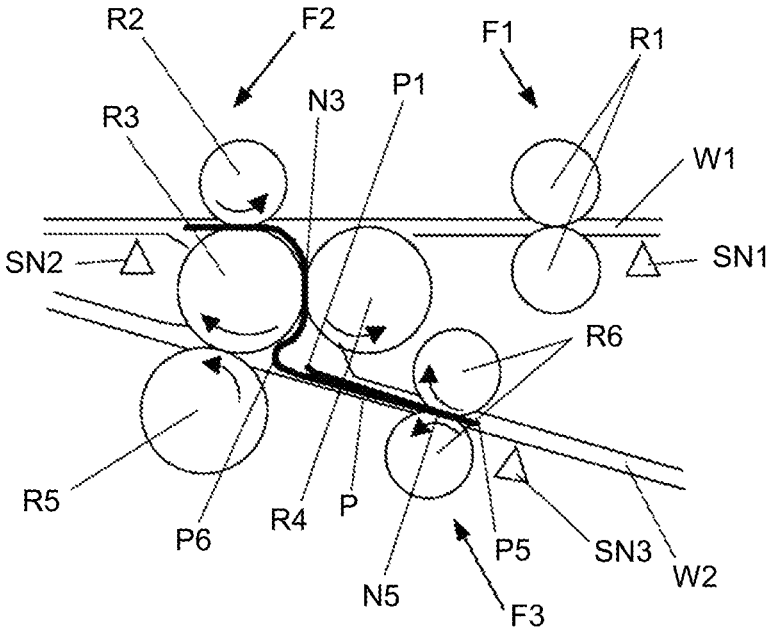
FIG. 28 is a diagram for explaining operation when the third conveying member is rotated in a reverse direction from the state illustrated in FIG. 27 and the sheet is deflected just before the nip of the second conveying member on the second conveying path.
Figure 29:
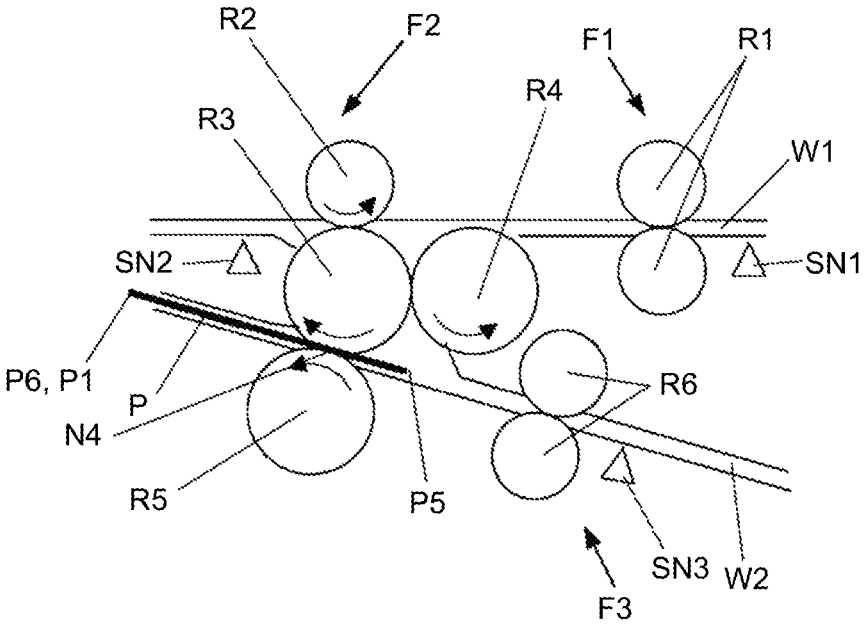
FIG. 29 is a diagram for explaining operation when the sheet is folded in two by the second conveying member from the state illustrated in FIG. 28.
Figure 30:
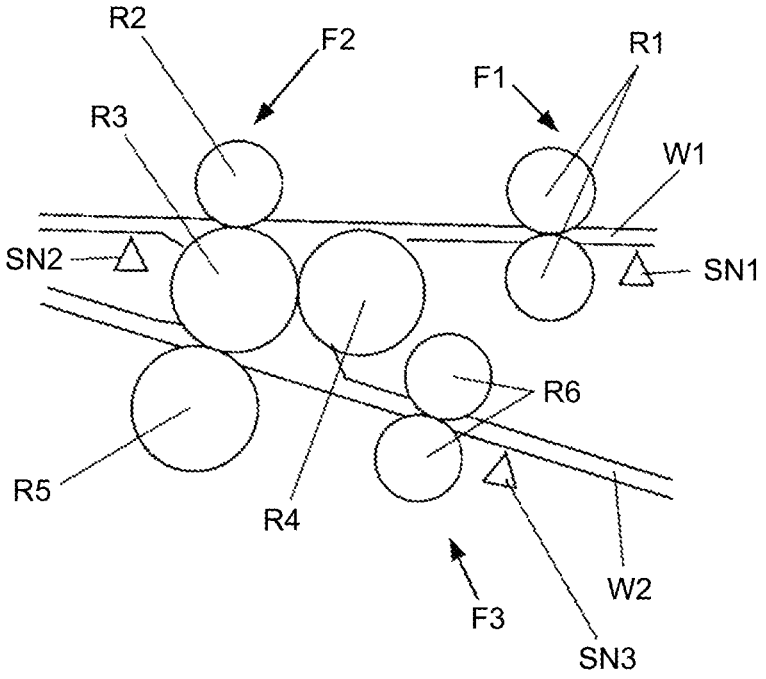
FIG. 30 is a diagram for explaining operation in an initial state before a sheet is conveyed from the image forming apparatus when outward three-folding is performed.
Figure 31:
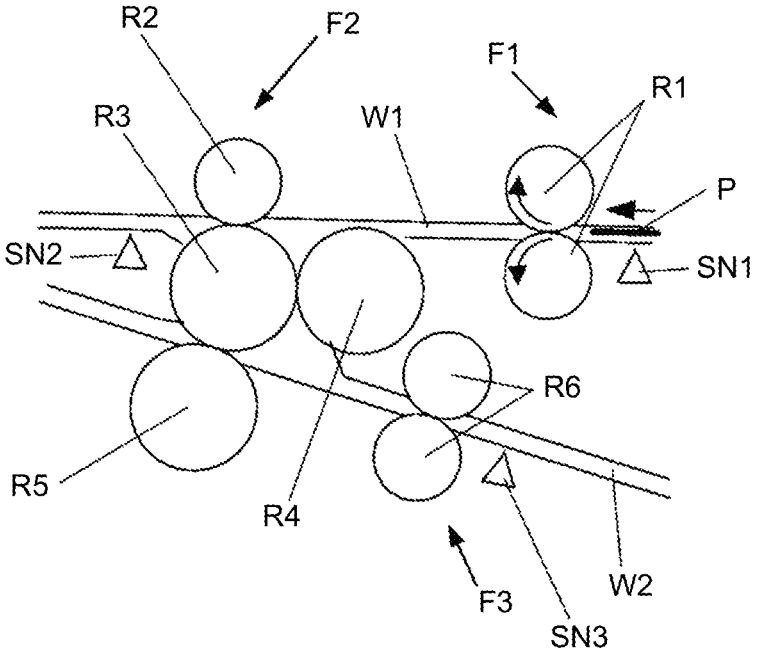
FIG. 31 is a diagram for explaining operation when the sheet is fed to the first conveying path from the image forming apparatus.
Figure 32:
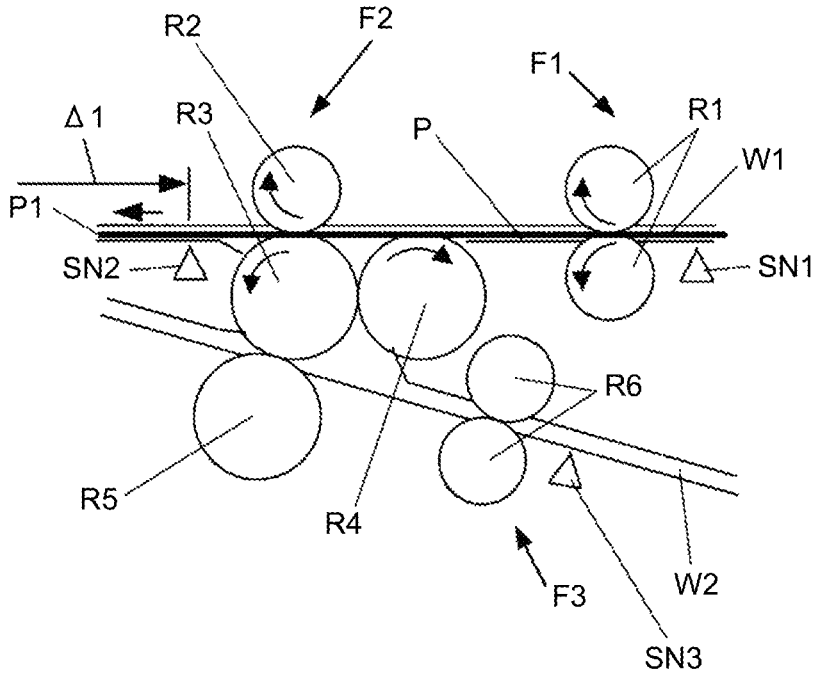
FIG. 32 is a diagram for explaining operation when the sheet is conveyed toward a folding position by the first and the second conveying members.

In the inward three-folding, the first crease P5 is located at two-thirds of the total length of the sheet in the conveying direction from a leading end P1 (FIG. 38B), and the first protrusion amount Δ1 is set in accordance with this folding position. After the sheet protrudes by the first protrusion amount Δ1, the second conveying member F2 is rotated in the reverse direction (FIG. 25). Furthermore, the second crease P6 is located at one-third of the total length of the sheet from the leading end P1 (FIG. 38B), and the second protrusion amount Δ2 is set in accordance with this folding position. In this case, similarly to the above, after the sheet protrudes by the second protrusion amount Δ2, the third conveying member F3 is rotated in the reverse direction (FIG. 28).

Figure 33:
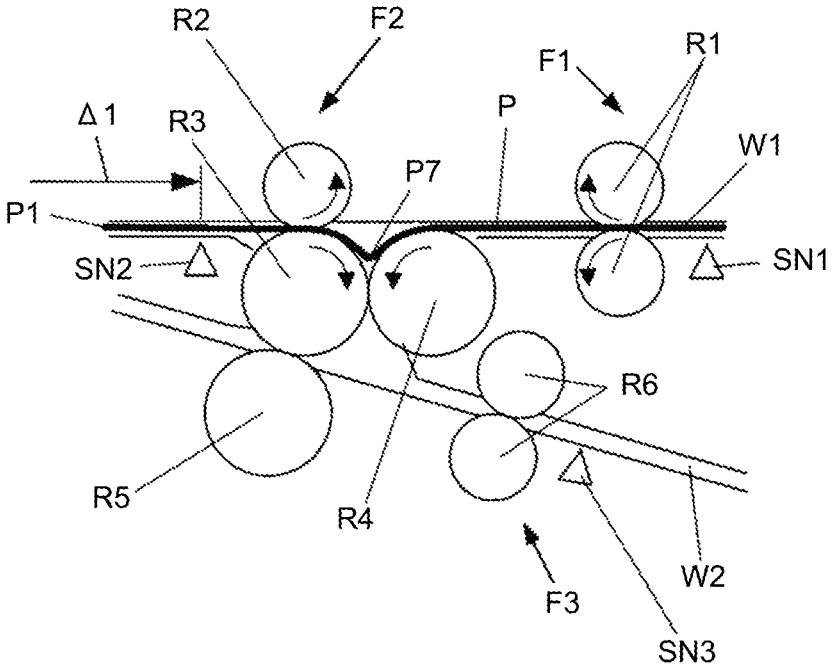
FIG. 33 is a diagram for explaining operation when the second conveying member is rotated in a reverse direction and the sheet is folded at a first folding position for the outward three-folding by the second conveying member.
Figure 34:
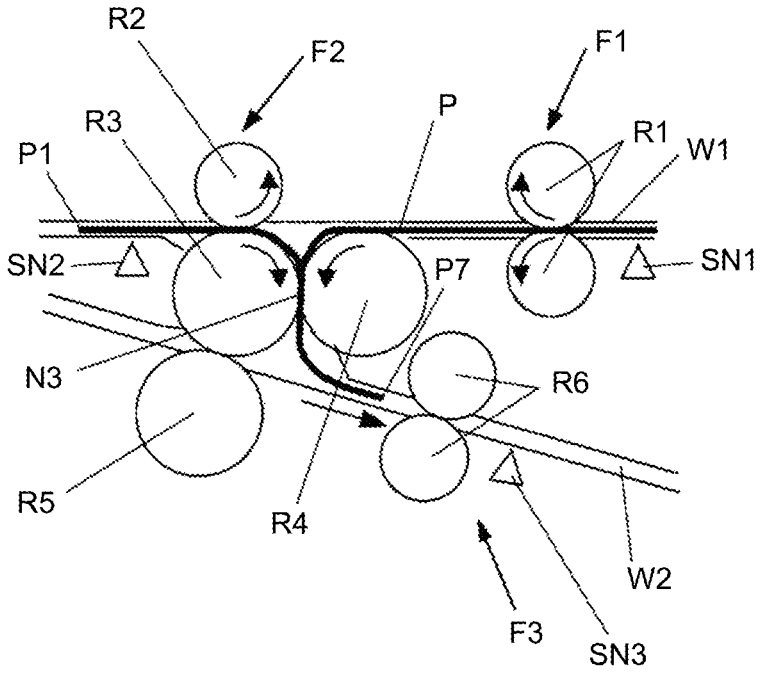
FIG. 34 is a diagram for explaining operation when the sheet subjected to the first folding by the second conveying member is conveyed through the second conveying path toward the third conveying member.
Figure 35:
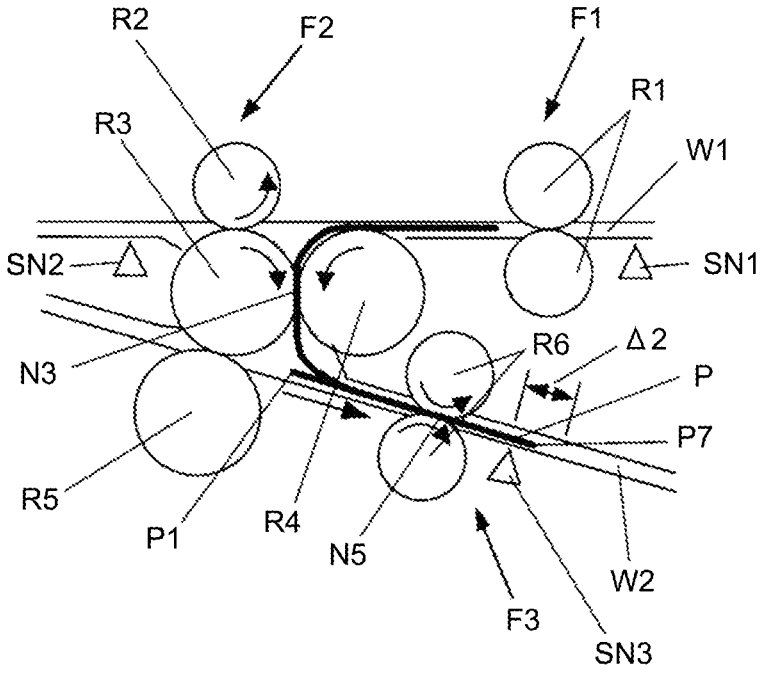
FIG. 35 is a diagram for explaining operation when the sheet is further conveyed by the third conveying member on the second conveying path.
Figure 36:
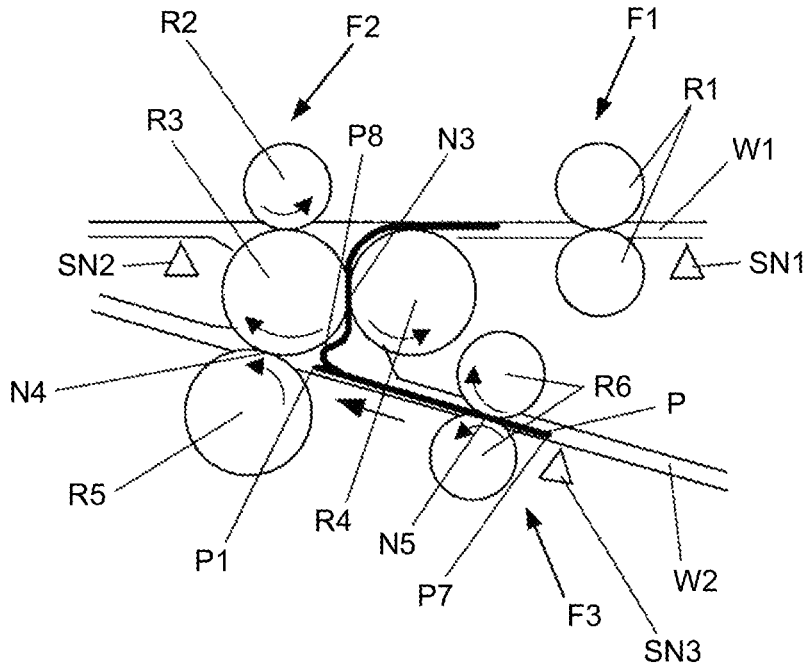
FIG. 36 is a diagram for explaining operation when the third conveying member is rotated in a reverse direction from the state illustrated in FIG. 35 and the sheet is deflected just before the nip of the second conveying member on the second conveying path.
Figure 37:
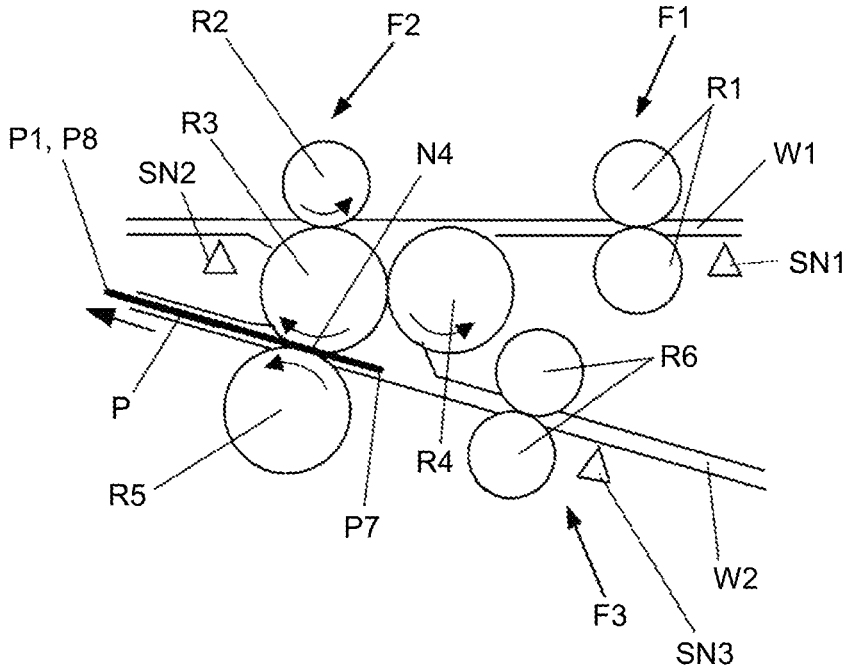
FIG. 37 is a diagram for explaining operation when the sheet is subjected to second folding by the second conveying member from the state illustrated in FIG. 36.

In contrast, in the outward three-folding, the first crease P7 is located at one-third of the total length of the sheet in the conveying direction from the leading end P1 of the sheet (FIG. 38C), and the first protrusion amount Δ1 corresponds to this folding position. After the sheet protrudes by the first protrusion amount Δ1, the second conveying member F2 is rotated in the reverse direction (FIG. 33). Furthermore, the second crease P6 is located at two-thirds of the total length of the sheet from the leading end P1 (FIG. 38C), and the second protrusion amount Δ2 corresponds to this folding position. In this case, similarly to the above, after the sheet protrudes by the second protrusion amount Δ2, the third conveying member F3 is rotated in the reverse direction (FIG. 36).

As described above, the folding mechanism illustrated in FIG. 3 enables to perform the two-folding, the Z-folding, the inward three-folding, and the outward three-folding on the sheet P.

Figure 39:
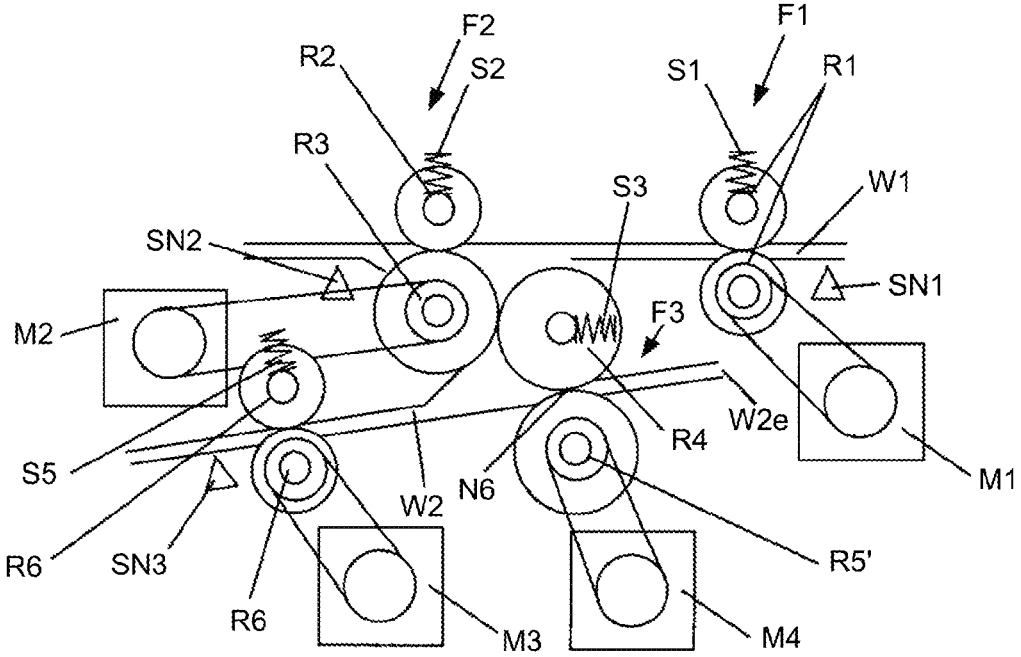
FIG. 39 is a diagram illustrating a modification of the second conveying member of the folding mechanism illustrated in FIG. 3.

FIG. 39 is a diagram illustrating a modification of the second conveying member F2 of the folding mechanism illustrated in FIG. 3.

In this modification, a sixth nip N6 is formed between the third conveying roller R4 and the fourth conveying roller R5 to perform final folding, instead of the fourth nip between the second conveying roller R3 and the fourth conveying roller R5 as illustrated in FIG. 3. Therefore, a fourth drive motor M4 that drives a fourth conveying roller R5' is provided. Furthermore, the third conveying member F3 is disposed on the left relative to the second conveying roller R3 in FIG. 39 in accordance with the above modification.

Even in this modification, the sheet folded by the third nip N3 is conveyed to the third conveying member F3 along the inclination of the downward slope of the second conveying path W2. Then, the crease is enhanced by the second conveying roller pair R6 of the third conveying member F3. Subsequently, the third conveying member F3 is rotated in the reverse direction to deflect the sheet before the sixth nip N6, and the sheet is folded by the third conveying roller R4 and the fourth conveying roller R5'. Thereafter, the sheet is discharged to a sheet discharge side W2*e* of the second conveying path W2 (a sheet feed side (the right side in FIG. 39) of the first conveying path W1). Therefore, the sheet subjected to the Z-folding, the inward three-folding, or the outward three-folding is discharged.

Figure 40:
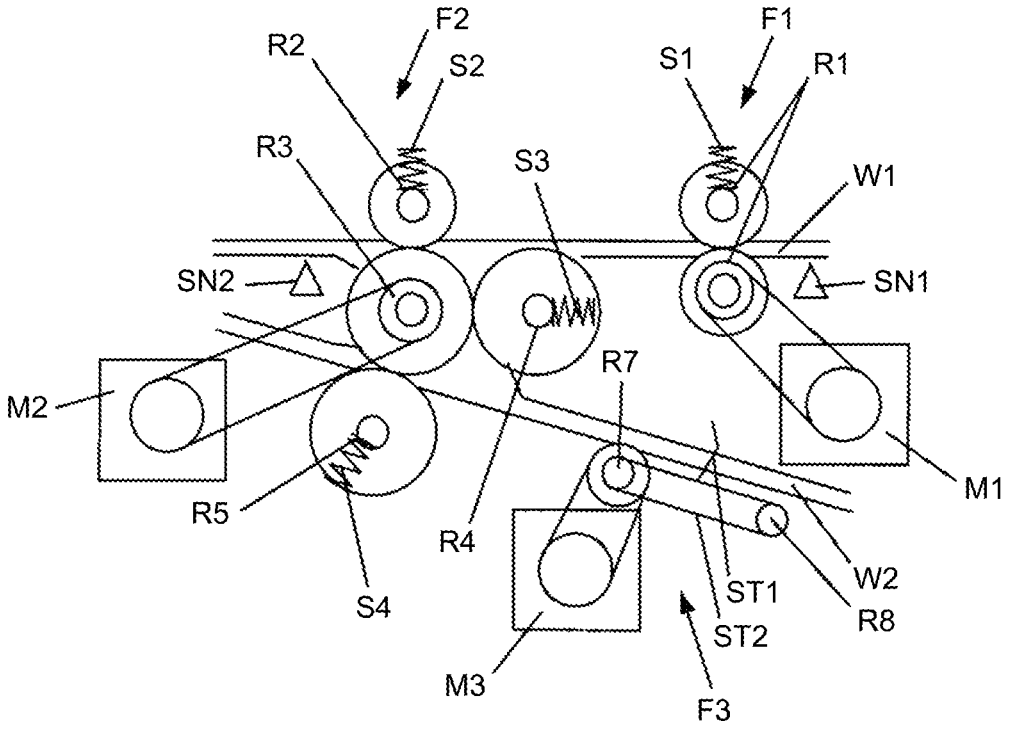
FIG. 40 is a diagram illustrating a modification of the third conveying member of the folding mechanism illustrated in FIG. 3.

FIG. 40 is a diagram illustrating a modification of the third conveying member F3 of the folding mechanism illustrated in FIG. 3.

In this modification, the third conveying member F3 is formed by a leading-end stopper ST1 that moves on the second conveying path W2, instead of the second conveying roller pair R6 illustrated in FIG. 3. This modification is an example in which a conventional stopper is partly applied. In FIG. 40, the leading-end stopper ST1 is arranged on a conveying belt ST2 stretched between a driving roller R7 and a driven roller R8 and protrudes to cross the conveying direction of the second conveying path W2. Therefore, the position of the leading end of the sheet P in the conveying direction is regulated by the leading-end stopper ST1. In this configuration, the leading-end stopper ST1 is moved along with the conveying belt ST2.

Therefore, the folding position of the sheet P corresponding to the second protrusion amount Δ2 can be set unambiguously based on the position of the leading-end stopper ST1 instead of based on the amount of rotation of the second conveying roller pair R6. The position of the leading-end stopper ST1 is controlled based on the driving steps of the third drive motor M3 that drives the driving roller. By comparison of FIG. 40 and FIG. 3, a configuration using the conveying roller that is rotatable in the forward and the reverse directions as illustrated in FIG. 3 is advantageous to reduce the size of the apparatus.

Incidentally, while the conveying rollers are used as the first conveying member F1, the second conveying member F2, and the third conveying member F3 in the embodiment, for example, air suction rollers may be used instead of the conveying rollers. Furthermore, an air suction belt may be used instead of the conveying roller at a portion irrelevant to the folding.

As is apparent from the above descriptions, the following advantageous effects can be achieved by the embodiments.

1) An apparatus includes a first pair of conveying members (R1*a* and R1*b*) that convey a sheet (P), a second pair of conveying members (R2 and R3) that receive the sheet (P) conveyed by the first pair of the conveying members (R1*a* and R1*b*) and further conveys the sheet (P) to a subsequent stage, and a third pair of conveying members (R3 and R4) that folds the sheet (P) by rotating the second pair of the conveying members (R2 and R3) in a reverse direction while the sheet (P) is held by the first pair of the conveying members (R1*a* and R1*b*) and the second pair of the conveying member pairs (R2 and R3). One (R3) of the conveying members (R2 and R3) of the second pair serves as one (R3) of the conveying members (R3 and R4) of the third pair. Therefore, it becomes possible to perform a folding process with a conveying path of a short length without using a stopper, so that the size of the apparatus can be reduced. Furthermore, the second pair of the conveying members (R2 and R3) and the third pair of the conveying members (R3 and R4) can be driven by a single drive source, so that the size of the apparatus can further be reduced.

2) The apparatus further includes a fourth pair of conveying members (R3 and R5) that further fold the sheet P that has been folded by the third pair of the conveying members (R3 and R4), at the downstream of the third pair of the conveying members (R3 and R4). Therefore, three-folding, such as Z-folding, inward three-folding, and outward three-folding, can be performed only by combination of the conveying roller pairs.

3) One (R3) of the conveying members (R2 and R3) of the second pair serves as one (R3) of the conveying members (R3 and R5) of the fourth pair. Therefore, the second pair of the conveying members (R2 and R3) and the fourth pair of the conveying members (R3 and R4) can be driven by a single drive source and the size of the apparatus can be reduced.

4) The other one (R4) of the conveying members (R3 and R4) of the third pair serves as one (R4) of the conveying members (R4 and R5') of the fourth pair. Therefore, three-folding, such as Z-folding, inward three-folding, and outward three-folding, can be performed only by combination of the conveying roller pairs.

5) The apparatus includes a first conveying path (W1) through which the sheet is conveyed from the first pair of the conveying members (R1*a* and R1*b*) to the second pair of the conveying members (R2 and R3), and a second conveying path W2 through which the sheet folded by the third pair of the conveying members (R3 and R4) is discharged. The third pair of the conveying members (R3 and R4) is disposed between the first conveying path (W1) and the second conveying path (W2). Therefore, the folding process can be performed without using a conveying path that is formed to directly branch from the first conveying path (W1). Furthermore, it is sufficient that the second conveying path (W2) is long enough to discharge the folded sheet, so that the length of the conveying path can be minimized. Therefore, when the apparatus is combined with the image forming apparatus (200), it becomes possible to dispose a folding apparatus (sheet processing apparatus) (100) that can perform two-folding and three-folding, in a so-called body inside sheet discharge unit (200*a*) formed between the main body of the image forming apparatus (200) and an image reading apparatus.

6) The apparatus includes the first conveying path (W1) through which the sheet is conveyed from the first pair of the conveying members (R1*a* and R1*b*) to the second pair of the conveying members (R2 and R3), and the second conveying path (W2) through which the sheet folded by the third pair of the conveying members (R3 and R4) is discharged. The fourth pair of the conveying member (R3, R5, R4, and R5') is disposed such that the conveying members sandwich the second conveying path (W2). Therefore, it is possible to directly discharge the folded sheet (P).

7) The apparatus includes a setting member (R6) that sets, in the second conveying path (W2), a position of a leading end of the sheet folded by the third pair of the conveying members (R3 and R4), a first crease (P3, P5, or P7) being formed at the leading end. Therefore, it is possible to set the position of a second crease by the setting member (R6).

8) The setting member (R6) is a pair of conveying members that convey the folded sheet (P) and set an amount of conveyance in accordance with a position where a second crease (P4, P6, or P8) is to be formed. Therefore, it is possible to form the second crease (P4, P6, or P8) with accuracy.

9) The setting member (R6) is a regulator member (ST1) that regulates the position of the leading end of the folded sheet being conveyed, in accordance with the position where the second crease (P4, P6, or P8) is to be formed, the first crease being formed at the leading end. Therefore, a moving range of the regulator member (ST1) in the second conveying path W2 can be reduced, so that the size of the apparatus is less likely to increase.

10) The pairs of the conveying members are pairs of conveying rollers. Therefore, the apparatus can be constructed at low costs.

11) When the second pair of the conveying members (R2 and R3) is rotated in the reverse direction, the protrusion amount Δ0 or Δ1 from the second pair of the conveying members (R2 and R3) is set based on the size of the sheet and a type of sheet folding. Therefore, it is possible to set a folding position with a simple structure and with high accuracy.

12) The apparatus includes a first conveying member (F1) that conveys the sheet (P) along the first conveying path (W1), a second conveying member (F2) that includes a first, a second, a third, and a fourth conveying rollers (R2, R3, R4, and R5), and a second conveying path (W2) through which the sheet (P) subjected to a folding process is discharged. The first conveying roller (R2) forms a nip with the second conveying roller (R3) while sandwiching the first conveying path (W1), the fourth conveying roller (R5) forms a nip with the second conveying roller (R3) while sandwiching the second conveying path (W2), the third conveying roller (R4) forms a nip with the second conveying roller (R3), between the first conveying path (W1) and the second conveying path (W2), the second conveying roller (R3) is rotated in a reverse direction while the sheet (P) is held by the first conveying member (F1) and the second conveying member (F2) to thereby fold the sheet (P) by the nip between the second conveying roller (R3) and the third conveying roller (R4) to form a first crease (P3, P5, or P7), the third conveying member (F3) regulates a leading end at which the first crease is formed, in the second conveying path (W2), to thereby fold the sheet (P) by the nip between the second conveying roller (R3) and the fourth conveying roller (R5) to form a second crease (P4, P6, or P8). Therefore, it is possible to perform three-folding, such as Z-folding, inward three-folding, and outward three-folding, only by the conveying roller pairs. Consequently, it becomes possible to perform a folding process with a conveying path of a short length without using the stopper, enabling to reduce the size of the apparatus.

13) The apparatus includes a first conveying member (F1) that conveys the sheet (P) along the first conveying path (W1), a second conveying member (F2) that includes a first, a second, and a third conveying rollers (R2, R3, and R4), a second conveying path (W2) through which the sheet (P) subjected to a folding process is discharged, and a fourth conveying roller (R5') that forms a nip with the third conveying roller (R4). The first conveying roller (R2) forms a nip with the second conveying roller (R3) while sandwiching the first conveying path (W1), the fourth conveying roller (R5') forms a nip with the third conveying roller (R4) while sandwiching the second conveying path (W2), the third conveying roller (R4) forms a nip with the second conveying roller (R3), between the first conveying path (W1) and the second conveying path (W2), the second conveying roller (R3) is rotated in a reverse direction while the sheet (P) is held by the first conveying member (F1) and the second conveying member (F2) to thereby fold the sheet (P) by the nip between the second conveying roller (R3) and the third conveying roller (R4) to form the first crease (P3, P5, or P7), the third conveying member (F3) regulates the leading end at which the first crease is formed, in the second conveying path (W2), to thereby fold the sheet (P) by the nip between the third conveying roller (R4) and the fourth conveying roller (R5') to form the second crease (P4, P6, or P8). Therefore, it becomes possible to perform three-folding, such as Z-folding, inward three-folding, or outward three-folding, by only the conveying roller pairs. Therefore, it is possible to perform a folding process with a conveying path of a short length without using a stopper, so that the size of the apparatus can be reduced.

Incidentally, when the folding apparatus 100 and the image forming apparatus 200 according to the embodiment are combined, the compact-size image forming system 1 can be structured, in which the folding apparatus 100 is incorporated in the body inside discharge unit 200*a* of the image forming apparatus 200.

In 1) to 13) described above, the reference numerals and symbols corresponding to the components of the embodiment of the present invention are denoted in parentheses to clarify a relationship between the configuration of the appended claims and the components of the embodiments.

According to the embodiments, it is possible to perform a folding process with a conveying path of a short length, so that the size of the apparatus can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first pair of conveying members configured to convey a sheet;

a second pair of conveying members configured to receive the sheet conveyed by the first pair of the conveying members and further convey the sheet to a subsequent stage by conveying the sheet for a distance when rotating in a forward direction and then conveying the sheet to the subsequent stage by rotating in a reverse direction; and a third pair of conveying members configured to fold the sheet by reversing a rotation of the second pair of the conveying members while the sheet is held by the first pair of the conveying members and the second pair of the conveying members, wherein one of the conveying members of the second pair serves as one of the conveying members of the third pair, the one of the conveying members of the third pair being furthest from the first pair of conveying members among the third pair of conveying members.

2. The sheet processing apparatus according to claim 1, further comprising a fourth pair of conveying members configured to further fold the sheet that has been folded by the third pair of the conveying members, at the downstream of the third pair of the conveying members.

3. The sheet processing apparatus according to claim 2, wherein one of the conveying members of the second pair serves as one of the conveying members of the fourth pair.

4. The sheet processing apparatus according to claim 2, wherein the other one of the conveying members of the third pair serves as one of the conveying members of the fourth pair.

5. The sheet processing apparatus according to claim 1, wherein the first pair of the conveying members and the second pair of the conveying members define at least a part of a first conveying path; and an output of the third pair of the conveying members defines at least a part of a second conveying path, wherein the third pair of the conveying members is disposed between the first conveying path and the second conveying path.

6. The sheet processing apparatus according to claim 2, further comprising:

the first pair of the conveying members and the second pair of the conveying members define at least a part of a first conveying path; and an output of the third pair of the conveying members defines at least a part of a second conveying path, wherein the fourth pair of the conveying members is disposed such that the conveying members sandwich the second conveying path.

7. The sheet processing apparatus according to claim 5, further comprising a setting member that sets, in the second conveying path, a position of a leading end of the sheet folded by the third pair of the conveying members, a first crease being formed at the leading end.

8. The sheet processing apparatus according to claim 7, wherein the setting member is a pair of conveying members that convey the folded sheet and set an amount of conveyance in accordance with a position where a second crease is to be formed.

9. The sheet processing apparatus according to claim 7, wherein the setting member is a regulator member that regulates the position of the leading end of the folded sheet being conveyed, in accordance with a position where a second crease is to be formed, the first crease being formed at the leading end.

10. The sheet processing apparatus according to claim 1, wherein when the second pair of the conveying members is rotated in the reverse direction, a protrusion amount from the second pair of the conveying members is set based on a size of the sheet and a type of sheet folding.

11. An image forming system comprising:

the sheet processing apparatus according to claim 1; and an image forming apparatus.

12. The image forming system according to claim 11, wherein the sheet processing apparatus is in a body inside a sheet discharge unit of the image forming apparatus.

13. A sheet processing apparatus comprising:

a first conveying member configured to convey a sheet along a first conveying path; and a second conveying member including a first conveying roller, a second conveying roller, a third conveying roller, and a fourth conveying roller, the second conveying member configured to subject a sheet to a folding process and discharge the sheet through a second conveying path; and wherein the first conveying roller is configured to form a nip with the second conveying roller while sandwiching the first conveying path, the fourth conveying roller is configured to form a nip with the second conveying roller while sandwiching the second conveying path, the third conveying roller is configured to form a nip with the second conveying roller, between the first conveying path and the second conveying path, the second conveying roller is configured to reverse a rotational direction and rotate in the reverse direction while the sheet is in contact with the first conveying member and the second conveying member, to thereby fold the sheet by the nip between the second conveying roller and the third conveying roller to form a first crease, the second conveying roller being further from the first conveying member than the third conveying roller, and a regulator member is configured to regulate a leading end at which the first crease is formed to thereby fold the sheet by the nip between the second conveying roller and the fourth conveying roller to form a second crease.

14. The sheet processing apparatus according to claim 13, wherein the regulator member is a pair of conveying rollers, and is configured to set a position of the leading end of the first crease in the second conveying path.

15. An image forming system comprising:

the sheet processing apparatus according to claim 13; and an image forming apparatus.

16. The image forming system according to claim 15, wherein the sheet processing apparatus is in a body inside a sheet discharge unit of the image forming apparatus.

17. A sheet processing apparatus comprising:

a first conveying member configured to convey a sheet along a first conveying path;

a second conveying member including a first conveying roller, a second conveying roller, and a third conveying roller, the second conveying member configured to subject a sheet to a folding process and discharge the sheet through a second conveying path; and a fourth conveying roller configured to form a nip with the third conveying roller, wherein the first conveying roller is configured to form a nip with the second conveying roller while sandwiching the first conveying path, the fourth conveying roller is configured to form a nip with the third conveying roller while sandwiching the second conveying path, the third conveying roller is configured to form a nip with the second conveying roller, between the first conveying path and the second conveying path, the second conveying roller is configured to reverse a rotational direction and rotated in the reverse direction while the sheet is in contact with the first conveying member and the second conveying member, to thereby fold sheet by the nip between the second conveying roller and the third conveying roller to form a first crease, the second conveying roller being further from the first conveying member than the third conveying roller, and a regulator member is configured to regulate a leading end at which the first crease is formed to thereby fold the sheet by the nip between the third conveying roller and the fourth conveying roller to form a second crease.

18. The sheet processing apparatus according to claim 17, wherein the regulator member is a pair of conveying rollers, and is configured to set a position of the leading end of the first crease in the second conveying path.

19. An image forming system comprising:

the sheet processing apparatus according to claim 17; and an image forming apparatus.

20. The image forming system according to claim 19, wherein the sheet processing apparatus is a body inside a sheet discharge unit of the image forming apparatus.

* * * * *